US010669711B2

(12) United States Patent
Parshad

(10) Patent No.: US 10,669,711 B2
(45) Date of Patent: Jun. 2, 2020

(54) CONNECTOR FOR LIGHTWEIGHT OFFICE PARTITION

(71) Applicant: Inscape Corporation, Holland Landing (CA)

(72) Inventor: David Parshad, Markham (CA)

(73) Assignee: Inscape Corporation, Holland Landing (CA)

( * ) Notice: Subject to any disclaimer, the term of this patent is extended or adjusted under 35 U.S.C. 154(b) by 0 days.

(21) Appl. No.: 15/992,886

(22) Filed: May 30, 2018

(65) Prior Publication Data

US 2018/0355607 A1 Dec. 13, 2018

(30) Foreign Application Priority Data

Jun. 9, 2017 (CA) ..... 2970210

(51) Int. Cl.

| | |
|---|---|
| ***E04B 1/61*** | (2006.01) |
| ***E04B 2/74*** | (2006.01) |
| ***E04B 2/08*** | (2006.01) |
| ***E04C 2/30*** | (2006.01) |
| ***E04F 13/12*** | (2006.01) |
| ***E04F 13/08*** | (2006.01) |
| ***A47F 11/02*** | (2006.01) |
| ***E04C 2/38*** | (2006.01) |
| ***E04F 15/02*** | (2006.01) |

(52) U.S. Cl.

CPC ..... *E04B 2/08* (2013.01); *A47F 11/02* (2013.01); *E04B 1/6116* (2013.01); *E04B 1/6162* (2013.01); *E04B 2/7405* (2013.01); *E04B 2/7425* (2013.01); *E04C 2/30* (2013.01); *E04C 2/38* (2013.01); *E04F 13/0803* (2013.01); *E04F 13/0837* (2013.01); *E04F 13/12* (2013.01); *E04F 15/02* (2013.01)

(58) Field of Classification Search

CPC .... E04B 1/6116; E04B 2/7425; E04B 2/7427; E04C 2/30; E04F 13/0803; E04F 13/0837; A47F 11/02

USPC ..... 52/238.1, 239, 241–243

See application file for complete search history.

(56) References Cited

U.S. PATENT DOCUMENTS

| | | | | |
|---|---|---|---|---|
| 1,000,395 A * | 8/1911 | Frost | A63H 33/042 446/104 |
| 2,746,109 A | 5/1956 | Budai | |
| 2,849,832 A * | 9/1958 | Jorgensen | A63H 33/105 446/122 |
| 3,490,800 A | 1/1970 | Wissler | |
| 3,626,652 A | 12/1971 | Hanley | |

(Continued)

FOREIGN PATENT DOCUMENTS

| | | |
|---|---|---|
| CH | 603117 | 12/1977 |
| DE | 2857450 A1 * | 8/1980 |

(Continued)

*Primary Examiner* — Joshua J Michener
*Assistant Examiner* — Charissa Ahmad
(74) *Attorney, Agent, or Firm* — Thorpe North & Western, LLP

(57) ABSTRACT

A removable connector used for connecting two or more wall panels. The connector is accessible to a user in a vertical space between the connected wall panels open to both front face and rear face of each panel. The user is able to easily engage and move the connector, relative to the wall panels, to latch and unlatch the connector with a view to connecting and disconnect the panels.

18 Claims, 18 Drawing Sheets

(56) References Cited

U.S. PATENT DOCUMENTS

| | | | | |
|---|---|---|---|---|
| 3,722,157 | A | 3/1973 | Prokop | |
| 4,334,374 | A | 6/1982 | Spamer et al. | |
| 4,712,336 | A * | 12/1987 | Backer | E04B 1/34384 160/351 |
| 4,928,465 | A | 5/1990 | Del Castillo Von Haucke | |
| 4,993,205 | A * | 2/1991 | Dull | E04B 2/7425 52/239 |
| 5,003,740 | A * | 4/1991 | Dull | E04B 2/7425 52/126.4 |
| 5,054,255 | A | 10/1991 | Maninfior | |
| 5,295,754 | A | 3/1994 | Kato | |
| 5,377,466 | A | 1/1995 | Insalaco et al. | |
| 5,473,845 | A | 12/1995 | Livingston et al. | |
| 5,522,193 | A | 6/1996 | Sommerstein et al. | |
| 5,606,836 | A | 3/1997 | Insalaco et al. | |
| 5,617,694 | A * | 4/1997 | Baba | E04B 1/2604 403/12 |
| 6,088,989 | A * | 7/2000 | Matsu | A47B 47/04 52/36.5 |
| 8,252,137 | B2 | 8/2012 | Fleming, III | |
| 8,322,104 | B2 | 12/2012 | Fleming, III | |
| 8,689,511 | B2 | 4/2014 | Fleming, III | |
| 9,068,581 | B2 | 6/2015 | Fleming, III | |
| 10,246,873 | B1 * | 4/2019 | Costanza | E04B 2/7425 |
| 2016/0053491 | A1 | 2/2016 | Fleming, III | |
| 2016/0356079 | A1 * | 12/2016 | Gauvin | E04B 2/7422 |

FOREIGN PATENT DOCUMENTS

| | | | | |
|---|---|---|---|---|
| DE | 3203804 | A1 * | 8/1983 | A47F 11/02 |
| EP | 0172989 | A2 * | 3/1986 | A47F 5/14 |

* cited by examiner 10
14
20
18
22
26
28
36
38
27
40
42
48
12
23
24
31

CONNECTOR FOR LIGHTWEIGHT OFFICE PARTITION

SCOPE OF THE INVENTION

This invention relates to a wall panel connector and, more particularly, to a wall panel connector for connecting one or more space dividing wall panels or lightweight office partitions.

BACKGROUND OF THE INVENTION

Various connectors are well known for connecting space dividing wall panels and lightweight office partitions. A disadvantage of previously known connectors appreciated by the present invention is that once the wall panels are connected, the connector is concealed between the wall panels' abutting lateral ends and the connector ceases to be readily accessible between the wall panels for easy engagement by a user who desires to unlatch the connector and disconnect the panels.

SUMMARY OF THE INVENTION

To at least partially overcome the disadvantages of previously known devices, the present invention provides a wall panel connector accessible to a user in a vertical space between connected wall panels, the vertical space being open to both the front face and the rear face of each panel.

In accordance with a first aspect, the present invention provides a wall panel system comprising:

a first wall panel having a first front face and a first rear face and first peripheral edges about each of the first front face and the first rear face with the first peripheral edges of the first front face joined to complementary first peripheral edges of the first rear face by first lateral end surfaces including a first panel lateral end surface disposed vertically, a first panel slotway in the first panel extending from a vertical first entrance opening in the first panel lateral end surface horizontally inwardly into the first panel between the first front face and the first rear face of the first wall panel, a horizontal first transverse pin member spanning the first panel slotway extending horizontally across the first panel slotway transverse to the first panel slotway, a second wall panel having a second front face and a second rear face and peripheral edges about each of the second front face and the second rear face with the second peripheral edges of the second front face joined to complementary second peripheral edges of the second rear face by second lateral end surfaces including a second panel lateral end surface disposed vertically, a second panel slotway in the second panel extending from a vertical second entrance opening in the second panel lateral end surface horizontally inwardly into the second panel between the second front face and the second rear face of the second wall panel;

a horizontal second transverse pin member spanning the second panel slotway extending horizontally across the second panel slotway transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and a rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal tongue end, the first tongue carrying a first catch arm extending downwardly to a first lower distal end, the first catch arm having a first outer catch surface directed towards the first lateral shoulder surface, the second tongue carried on the second lateral shoulder surface extending away from the second lateral shoulder surface to a second distal tongue end, the second tongue carrying a second catch arm extending downwardly to a second lower distal end, the second catch arm having a second outer catch surface directed towards the second lateral shoulder surface, the first tongue slidable horizontally relative the first wall panel into the first panel slotway with the first distal end of the first catch arm inserted into the first panel slotway above the first transverse pin member until in a first unlatched position the first lateral shoulder surface engages the first panel lateral end surface about the first panel slotway limiting insertion with the first outer catch surface of the first catch arm vertically above the first transverse pin member, the second tongue slidable horizontally relative the second wall panel into the second panel slotway with the second distal end of the second catch arm inserted into the second panel slotway above the second transverse pin member until in a second unlatched position the second lateral shoulder surface engages the second panel lateral end surface about the second panel slot way limiting insertion with the second outer catch surface of the second catch arm vertically above the second transverse pin member, with the connector simultaneously in (a) the first inserted unlatched position relative the first wall panel, and (b) the second inserted unlatched position relative the second wall panel, the connector is slidable vertically downwardly to simultaneously (i) engage the first outer catch surface of the first catch arm with the first transverse pin member and assume a first latched position in which engagement between the first transverse pin member and first outer catch surface of the first catch arm prevents horizontal sliding of the connector relative to the first wall panel in a direction that moves the first lateral shoulder surface away from first panel lateral end surface, and (ii) engage the second outer catch surface of the second catch arm with the second transverse pin member and assume a second latched position in which engagement between the second transverse pin member and the second outer catch surface of the second catch arm prevents horizontal sliding of the connector relative to the second wall panel in a direction that moves the second lateral shoulder surface away from second panel lateral end surface, with the connector simultaneously in (a) the first unlatched position relative the first wall panel, and (b) the second unlatched position relative the second wall panel, the spacing rib is disposed in the vertical space accessible to a user between the first panel lateral end surface and the second panel lateral end surface for engagement by a user to move the connector vertically relative the first wall panel and the second wall panel, and with the connector simultaneously in (a) the first latched position relative the first wall panel, and (b) the second latched position relative the second wall panel, the spacing rib is disposed in the space accessible to a user between the first panel lateral end surface and the second panel lateral end surface for engagement by a user to move the connector vertically relative the first wall panel and the second wall panel.

In a $2^{nd}$ aspect, the wall panel system of the $1^{st}$ aspect is provided wherein:

the first tongue provides a first access bight defined in part by the first outer catch surface which opens downwardly, the first pin member slidable vertically within the first access bight between the first inserted unlatched position and the first latched position, the second tongue provides a second access bight defined in part by the second outer catch surface which opens downwardly, the second pin member slidable vertically within the second access bight between the second inserted unlatched position and the second latched position.

In a $3^{rd}$ aspect, the wall panel system of the $2^{nd}$ aspect is provided wherein:

the first access bight includes a first blind end wall directed downwardly, the first outer catch surface merges upwardly into the first blind end wall with the first blind end wall extending from the first outer catch surface towards the first lateral shoulder surface, and the second access bight includes a second blind end wall directed downwardly, the second outer catch surface merges upwardly into the second blind end wall with the second blind end wall extending from the second outer catch surface towards the second lateral shoulder surface.

In a $4^{th}$ aspect, the wall panel system of the $3^{rd}$ aspect is provided wherein:

in the first latched position, the first blind end wall engages the first connector pin preventing vertical downward movement of the first tongue relative the first wall panel, and in the first latched position, the second blind end wall engages the second connector pin preventing vertical downward movement of the second tongue relative the second wall panel.

In a $5^{th}$ aspect, the wall panel system of the $3^{rd}$ or $4^{th}$ aspect is provided wherein:

the first access bight includes a first inner catch surface directed away from the first lateral shoulder surface and opposed to the first lateral shoulder surface, the first blind end wall merging towards the first lateral shoulder surface into the first outer catch surface which extends vertically downwardly from the first blind end wall, the first access bight defined between the first outer catch surface and the first inner catch surface, and the second access bight includes a second inner catch surface directed away from the second lateral shoulder surface and opposed to the second lateral shoulder surface, the second blind end wall merging towards the second lateral shoulder surface into the second outer catch surface which extends vertically downwardly from the second blind end wall, the second access bight defined between the second outer catch surface and the second inner catch surface.

In a $6^{th}$ aspect, the wall panel system of the $5^{th}$ aspect is provided wherein:

in the first latched position, engagement between the first transverse pin member and the first inner catch surface prevents horizontal sliding of the connector relative to the first wall panel in a direction that moves the first lateral shoulder surface toward the first panel lateral end surface, and in the second latched position, engagement between the second transverse pin member and the second inner catch surface prevents horizontal sliding of the connector relative to the second wall panel in a direction that moves the second lateral shoulder surface toward the second panel lateral end surface.

In a $7^{th}$ aspect, the wall panel system of any one of the $1^{st}$ to $6^{th}$ aspects is provided wherein:

the first panel slotway defined between a first front slot sidewall spaced rearwardly from the first front face towards the first rear face and a first rear slot side wall spaced forwardly from the first front face towards the first rear face, the first rear slot side wall spaced from the first front slot side wall and opposed to first front slot side wall, the horizontal first transverse pin member spanning the first panel slotway extending horizontally across the first panel slotway transverse to the first panel slotway from the first front slot side wall to the first rear slot side wall, the second panel slotway defined between a second front slot sidewall spaced rearwardly from the second front face towards the second rear face and a second rear slot side wall spaced forwardly from the second front face towards the second rear face, the second rear slot side wall spaced from the second front slot side wall and opposed to second front slot side wall, the horizontal second transverse pin member spanning the second panel slotway extending horizontally across the second panel slotway transverse to the second panel slotway from the second front slot side wall to the second rear slot side wall.

In an $8^{th}$ aspect, the wall panel system of the $7^{th}$ aspect is provided wherein:

the first tongue defined between a forwardly directed first front tongue face and a rearwardly directed first rear tongue face, in the latched condition, the first front tongue face engages the first front slot sidewall and the first rear tongue face engages the first rear slot sidewall to prevent movement of the first tongue forwardly and rearwardly relative to the first slotway, and the second tongue defined between a forwardly directed second front tongue face and a rearwardly directed second rear tongue face, in the latched condition, the second front tongue face engages the second front slot sidewall and the second rear tongue face engages the second rear slot sidewall to prevent movement of the second tongue forwardly and rearwardly relative to the second slotway.

In a $9^{th}$ aspect, the wall panel system of the $8^{th}$ aspect is provided wherein:

the spacing rib having a front to rear dimension greater than a front to rear spacing of the first front slot sidewall and the first rear slot sidewall such that the first lateral shoulder surface engages the first panel lateral end surface on each of a front side and a rear side of the vertical first entrance opening, and the spacing rib having a front to rear dimension greater than a front to rear spacing of the second front slot sidewall and the second rear slot sidewall such that the second lateral shoulder surface engages the second panel lateral end surface on each of a front side and a rear side of the vertical second entrance opening.

In a $10^{th}$ aspect, the wall panel system in any one of the $1^{st}$ to $9^{th}$ aspects is provided wherein:

the first panel slotway defined between a downwardly directed first slot top wall spaced upwardly from the first transverse pin and an upwardly directed first slot bottom wall spaced downwardly from the first transverse pin and opposed to the first slot top wall, and the second panel slotway defined between a downwardly directed second slot top wall spaced upwardly from the second transverse pin and an upwardly directed second slot bottom wall spaced downwardly from the second transverse pin and opposed to the second slot top wall.

In an $11^{th}$ aspect, the wall panel system of the $10^{th}$ aspect is provided wherein:

in the first latched position, a downwardly directed lower surface of the first tongue engages the first slot bottom wall to prevent vertical downward movement of the first tongue relative the first wall panel, and in the second latched position, a downwardly directed lower surface of the second tongue engages the second slot bottom wall to prevent vertical downward movement of the second tongue relative the second wall panel.

In a $12^{th}$ aspect, the wall panel system of the $10^{th}$ or $11^{th}$ aspect is provided wherein:

the first tongue has an upwardly directed first top surface, the first top surface slidably engagable with the downwardly directed first slot top wall to guide sliding of the first tongue in the first slotway to the first inserted unlatched position, and the second tongue has an upwardly directed second top surface, the second top surface slidably engagable with the downwardly directed second slot top wall to guide sliding of the second tongue in the second slotway to the second inserted unlatched position.

In a $13^{th}$ aspect, the wall panel system of any one of the $1^{st}$ to $12^{th}$ aspects is provided wherein:

the first panel slotway in the first panel extending from the vertical first entrance opening in the first panel lateral end surface horizontally inwardly into the first panel between the first front face and the first rear face of the first wall panel past the first transverse pin, and the second panel slotway in the second panel extending from the vertical second entrance opening in the second panel lateral end surface horizontally inwardly into the second panel between the second front face and the second rear face of the second wall panel past the second transverse pin.

In another aspect, the present invention provides a wall panel system, comprising:

a first wall panel having a first front face and a first rear face and first peripheral edges about each of the first front face and the first rear face with the first peripheral edges of the first front face joined to complementary first peripheral edges of the first rear face by first lateral end surfaces including a first panel lateral end surface disposed vertically, a first panel slotway in the first panel extending from a vertical first entrance opening in the first panel lateral end surface horizontally inwardly into the first panel between the first front face and the first rear face of the first wall panel, a horizontal first transverse pin member spanning the first panel slotway extending horizontally across the first panel slotway transverse to the first panel slotway, a second wall panel having a second front face and a second rear face and peripheral edges about each of the second front face and the second rear face with the second peripheral edges of the second front face joined to complementary second peripheral edges of the second rear face by second lateral end surfaces including a second panel lateral end surface disposed vertically, a second panel slotway in the second panel extending from a vertical second entrance opening in the second panel lateral end surface horizontally inwardly into the second panel between the second front face and the second rear face of the second wall panel;

a horizontal second transverse pin member spanning the second panel slotway extending horizontally across the second panel slotway transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and a rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal tongue end, the first tongue carrying a first catch arm extending upwardly to a first lower distal end, the first catch arm having a first outer catch surface directed towards the first lateral shoulder surface, the second tongue carried on the second lateral shoulder surface extending away from the second lateral shoulder surface to a second distal tongue end, the second tongue carrying a second catch arm extending upwardly to a second lower distal end, the second catch arm having a second outer catch surface directed towards the second lateral shoulder surface, the first tongue slidable horizontally relative the first wall panel into the first panel slotway with the first distal end of the first catch arm inserted into the first panel slotway below the first transverse pin member until in a first unlatched position, the first lateral shoulder surface engages the first panel lateral end surface about the first panel slotway limiting insertion with the first outer catch surface of the first catch arm vertically below the first transverse pin member, the second tongue slidable horizontally relative the second wall panel into the second panel slotway with the second distal end of the second catch arm inserted into the second panel slotway below the second transverse pin member until, in a second unlatched position, the second lateral shoulder surface engages the second panel lateral end surface about the second panel slotway limiting insertion with the second outer catch surface of the second catch arm vertically below the second transverse pin member, with the connector simultaneously in (a) the first inserted unlatched position relative the first wall panel, and (b) the second inserted unlatched position relative the second wall panel, the connector is slidable vertically upwardly to simultaneously (i) engage the first outer catch surface of the first catch arm with the first transverse pin member and assume a first latched position in which engagement between the first transverse pin member and first outer catch surface of the first catch arm prevents horizontal sliding of the connector relative to the first wall panel in a direction that moves the first lateral shoulder surface away from first panel lateral end surface, and (ii) engage the second outer catch surface of the second catch arm with the second transverse pin member and assume a second latched position in which engagement between the second transverse pin member and the second outer catch surface of the second catch arm prevents horizontal sliding of the connector relative to the second wall panel in a direction that moves the second lateral shoulder surface away from second panel lateral end surface, with the connector simultaneously in (a) the first unlatched position relative the first wall panel, and (b) the second unlatched position relative the second wall panel, the spacing rib is disposed in the vertical space accessible to a user between the first panel lateral end surface and the second panel lateral end surface for engagement by a user to move the connector vertically relative the first wall panel and the second wall panel, and with the connector simultaneously in (a) the first latched position relative the first wall panel, and (b) the second latched position relative the second wall panel, the spacing rib is disposed in the vertical space accessible to a user between the first panel lateral end surface and the second panel lateral end surface for engagement by a user to move the connector vertically relative the first wall panel and the second wall panel.

In another aspect, the present invention provides a wall panel system, comprising:

a first wall panel having a front face and a rear face and peripheral edges about each of the front face and the rear face with the peripheral edges of the front face joined to complementary peripheral edges of the rear face by first lateral end surfaces including a first panel lateral end surface disposed vertically, a first panel slotway extending vertically and longitudinally of the first panel lateral end surface between the front face and the rear face of the first wall panel inwardly into the first panel lateral end surface from a first entrance opening in the first panel lateral end surface, a first transverse pin member spanning the first panel slotway extending horizontally transverse to the first panel slotway, a second wall panel having a front face and a rear face and peripheral edges about each of the front face and the rear face with the peripheral edges of the front face joined to complementary peripheral edges of the rear face by second lateral end surfaces including a second panel lateral end surface disposed vertically, a second panel slotway extending vertically and longitudinally of the second panel lateral end surface between the front face and the rear face of the second wall panel inwardly into the second panel lateral end surface from a second entrance opening in the second panel lateral end surface, a second transverse pin member spanning the second panel slotway extending horizontally transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and a rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal tongue end, the first tongue carrying a first hook member with an access bight open vertically downwardly, the second tongue carried on the second lateral shoulder surface extending away from the second lateral shoulder surface to a second distal tongue end, the second tongue carrying a second hook member with an access bight open vertically downwardly, the first tongue slidable horizontally relative the first wall panel into the first panel slotway with the first distal end of the first catch arm inserted into the first panel slotway above the first transverse pin member until, in a first unlatched position, the first lateral shoulder surface engages the first panel lateral end surface about the first panel slotway limiting insertion with the bight of the first hook member above the first transverse pin member, the second tongue slidable horizontally relative the second wall panel into the second panel slotway with the second distal end of the second catch arm inserted into the second panel slotway above the second transverse pin member until, in a second unlatched position, the second lateral shoulder surface engages the second panel lateral end surface about the second panel slotway limiting insertion with the bight of the second hook member above the second transverse pin member, with the connector simultaneously in (a) the first inserted unlatched position relative the first wall panel, and (b) the second inserted unlatched position relative the second wall panel, the connector is slidable vertically downwardly to simultaneously (i) engage the first hook member about the first transverse pin member into a first latched position in which engagement between the first transverse pin member and the bight of the first hook member prevents horizontal sliding of the connector relative to the first wall panel, and (ii) engage the second hook member about the second transverse pin member into a second latched position in which engagement between the second transverse pin member and the bight of the second hook member prevents horizontal sliding of the connector relative to the second wall panel, with the connector simultaneously in (a) the first unlatched position relative the first wall panel, and (b) the second unlatched position relative the second wall panel, the spacing rib is disposed in the space accessible to a user between the first panel lateral end surface and the second panel lateral end surface for engagement by a user to move the connector vertically relative the first wall panel and the second wall panel, and with the connector simultaneously in (a) the first latched position relative the first wall panel, and (b) the second latched position relative the second wall panel, the spacing rib is disposed in the space accessible to a user between the first panel lateral end surface and the second panel lateral end surface for engagement by a user to move the connector vertically relative the first wall panel and the second wall panel.

The wall panels maybe supported on a floor by a base of the wall panel with the wall panel extending vertically upwardly from the base.

The wall panels may comprise a space dividing the wall panels.

The wall panels maybe capable of being lifted and moved manually by the user.

In another aspect, the present invention provides a wall panel system including a plurality of wall panels and a plurality of connectors, each wall panel having a front face and a rear face and peripheral edges about each of the front face and the rear face with the peripheral edges of the front face joined to complementary peripheral edges of the rear face by first lateral end surfaces including a right panel lateral end surface disposed vertically and a left panel lateral end surface disposed vertically, each of the right panel lateral end surface and the left panel lateral end surface having a slotway extending vertically and longitudinally of the respective right and left panel lateral end surface between the front face and the rear face of the wall panel inwardly into the respective right and left panel lateral end surface from an entrance opening in the respective right and left panel lateral end surface, each slotway having a transverse pin member spanning the slotway extending horizontally transverse to the slotway, at least one connector removably connecting a first of the wall panels to a second of the wall panels end-to-end with their panel lateral end surfaces opposed but spaced to form a vertical space between the opposed panel lateral end surfaces, the space open to both the front face and a rear face of each of the connected wall panels, each connector having a central vertical spacing rib, and two identical mirror image tongues, the central vertical spacing rib having a first lateral shoulder surface and a second lateral shoulder surface directed away from the first lateral shoulder surface, a first of the tongues carried on the first lateral shoulder surface extending away from the first lateral shoulder surface to a distal tongue end, a second of the tongues carried on the second lateral shoulder surface extending away from the second lateral shoulder surface to a second distal tongue end, each of the tongues carrying a hook member with an access bight open vertically downwardly, each of the tongues slidable horizontally relative each wall panel into each panel slotway with its distal end insertable into the panel slotway above the transverse pin member until, in an unlatched position, the rib member engages the panel lateral end surface about the panel slotway limiting insertion with the bight of the hook member above the transverse pin member, with one of the connectors simultaneously in (a) the unlatched position relative the first of the first wall panels, and (b) the unlatched position relative the second of the wall panels, the one of the connectors is slidable vertically downwardly to simultaneously (i) engage the hook member of a first of the tongues about the transverse pin member of the one of the wall panels in a latched position, and (ii) engage the hook member of a second of the tongues about the transverse pin member of the second of the wall panels in a latched position in which engagement between the transverse pin member and the bights of the hook members prevent horizontal sliding of the connector relative to each of the first and second wall panels, with the connector simultaneously in (a) the first unlatched position relative the first wall panel, and (b) the second unlatched position relative the second wall panel, the spacing rib is disposed in the space accessible to a user between the opposed panel lateral end surfaces for engagement by a user to move the connector vertically relative the first wall panels, and with the connector simultaneously in (a) the latched position relative the first of the wall panels, and (b) the latched position relative the second of the wall panels, the spacing rib is disposed in the space accessible to a user between the opposed panel lateral end surfaces for engagement by a user to move the connector vertically relative the wall panels.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Reference is made first to FIGS. 1 to 19 showing a wall panel system 10 in accordance with a first embodiment of the present invention. The wall panel system 10 is shown in FIGS. 1 to 19 as providing for the connection of two identical wall panels 14 together in an end-to-end configuration by the use of a removable connector 12 with the system providing a vertical space 16 between the ends of the two panels 14 when connected.

Figure 1:
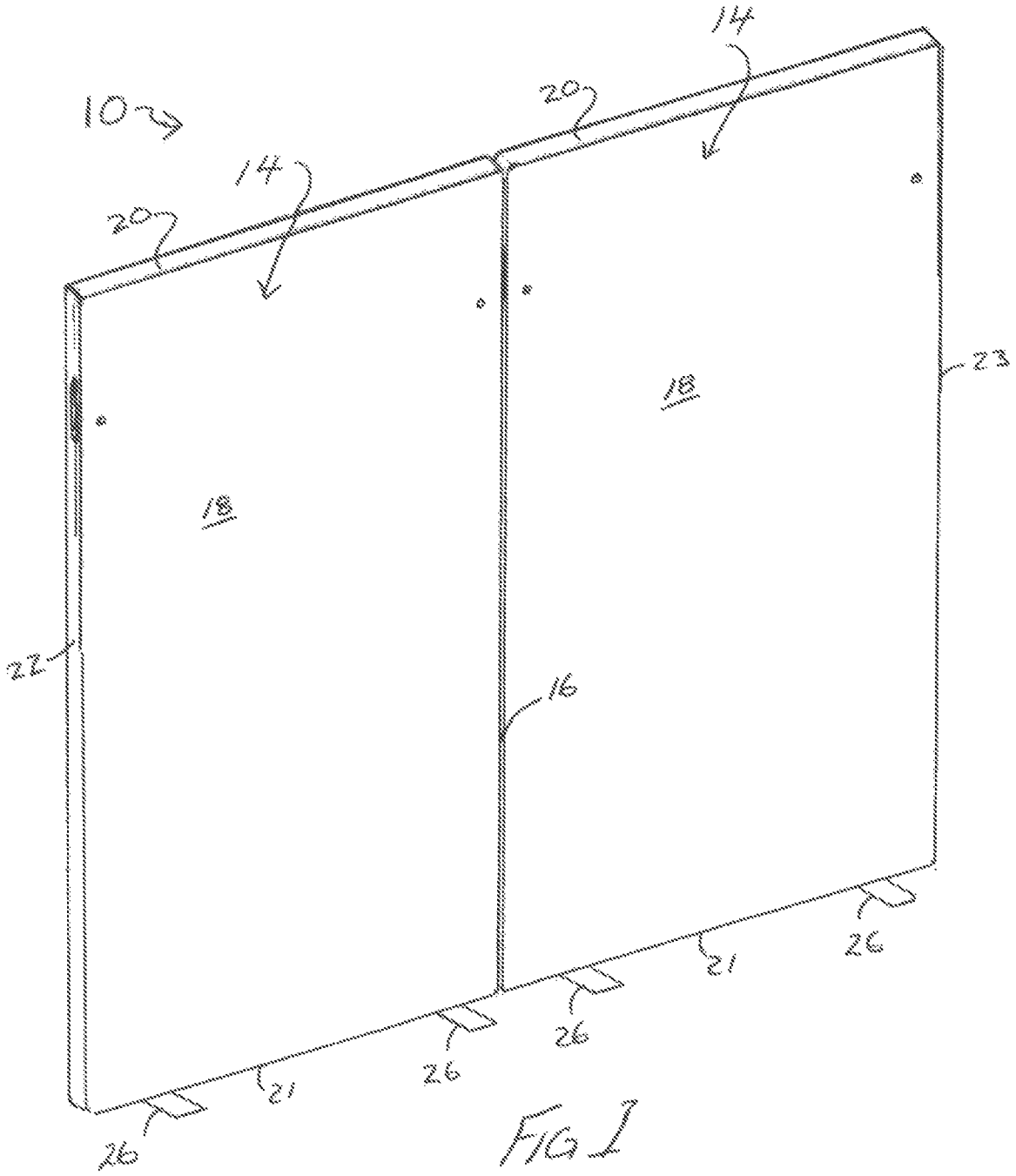
FIG. 1 is a schematic front pictorial view of a wall panel system in accordance with a first embodiment of the present invention and showing two wall panels connected end-to-end.
Figure 2:
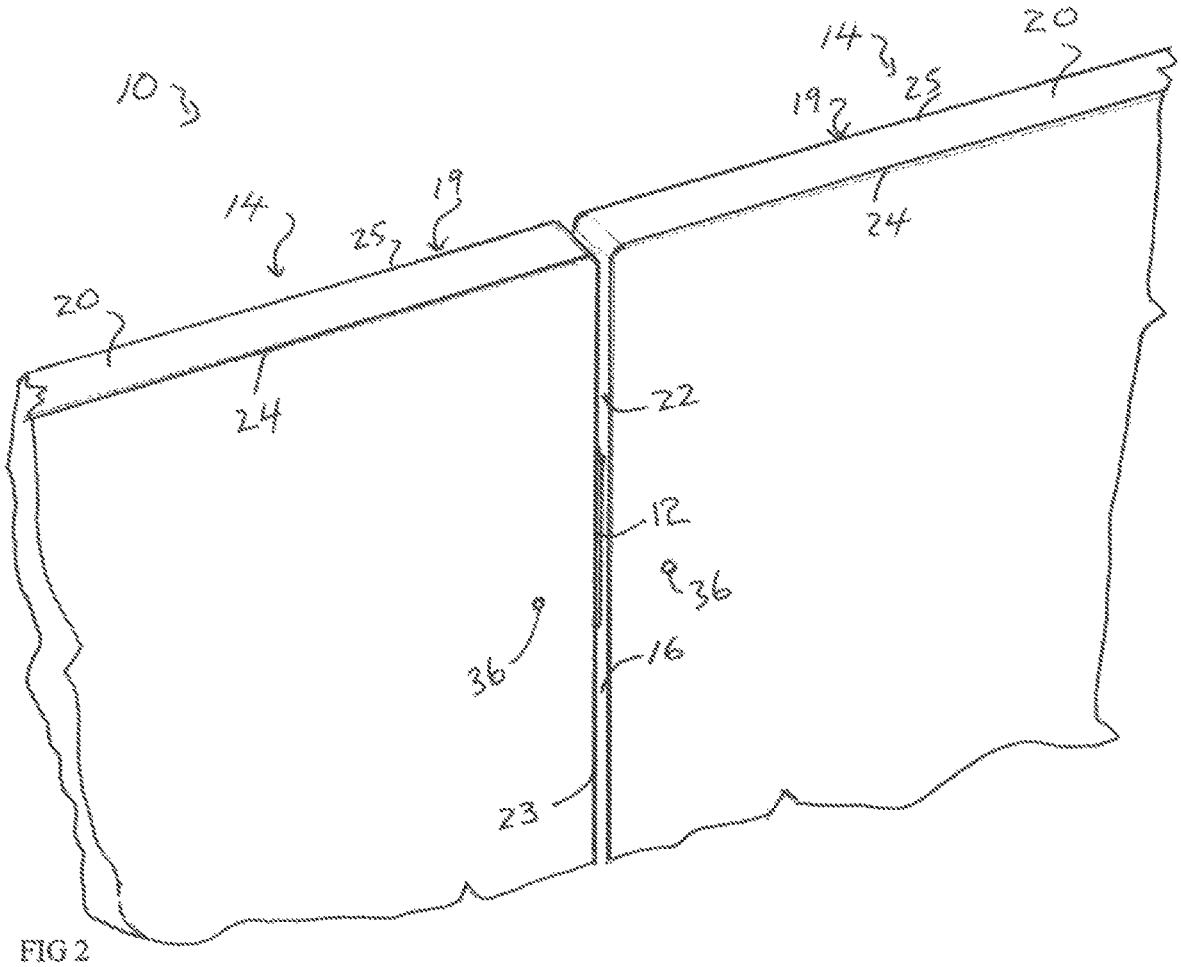
FIG. 2 is an enlarged front perspective view showing the upper corners of the two wall panels connected end-to-end as in FIG. 1.

For ease of illustration, the two wall panels 14 are shown as being identical and the same reference numerals are used to identify identical elements on each of the two wall panels. The two wall panels 14 comprise, as seen in FIG. 1, a first or left wall panel 14 on the left hand side of FIG. 1 and a second or right wall panel 14 on the right hand side of FIG. 1. Each wall panel 14 has as seen, for example, in FIGS. 1 and 9, a front face 18, a rear face 19, a top face 20, a bottom face 21, a left lateral end face 22 and a right lateral end face 23. The front face 18 has a circumferential peripheral edge 24 and the rear face 19 has a circumferential peripheral edge 25. The left lateral end face 22 joins the front face 18 to the rear face 19 by connecting the front face 18 to the rear face 19 along and between the complementary front edge 24 and the rear edge 25 at the lateral left end of the panel 14. Similarly, the right lateral end face 22 joins the front face 18 to the rear face 19 by connecting the front face 18 to the rear face 19 along and between the complementary front edge 24 and the rear edge 25 at the lateral right end of the panel 14.

Each panel 14 is supported on a floor by a pair of floor engagement feet 26 fixedly secured to the wall panel 14 and extending downwardly from the bottom face 21.

The provision as specific for engagement feet 26 is not necessary. In an alternate arrangement, not shown, the wall panels may simply be supported on a floor by a base portion of the panel as, for example, by the bottom face 21 engaging the floor with the wall panel to extend vertically upwardly from the face portion.

Preferably, each wall panel 14 is capable of being independently lifted and manually moved by a single person. In this regard, each wall panel 14 is preferably to be provided of a suitable size and weight for easy manual movement. The wall panels may preferably be formed with a lightweight frame such as from plywood or other suitable material and covered as with a lightweight fabric or other sheet material. Preferably, the wall panels will have sizes in the range of an end-to-end width in the range of 18 inches to 8 feet and heights in the range of 4 feet to 8 feet without limitation. Preferably, the wall panels may have a thickness between the front face 18 and the rear face 19 in the range of 2 inches to ¾ inch, more preferably, not greater than 1.5 inches. In the preferred embodiment as illustrated in the Figures, each wall panel 14 comprises a single sheet of laminated plywood whose surface may be, for example, painted or stained or provided with a decorative veneer.

Figure 3:
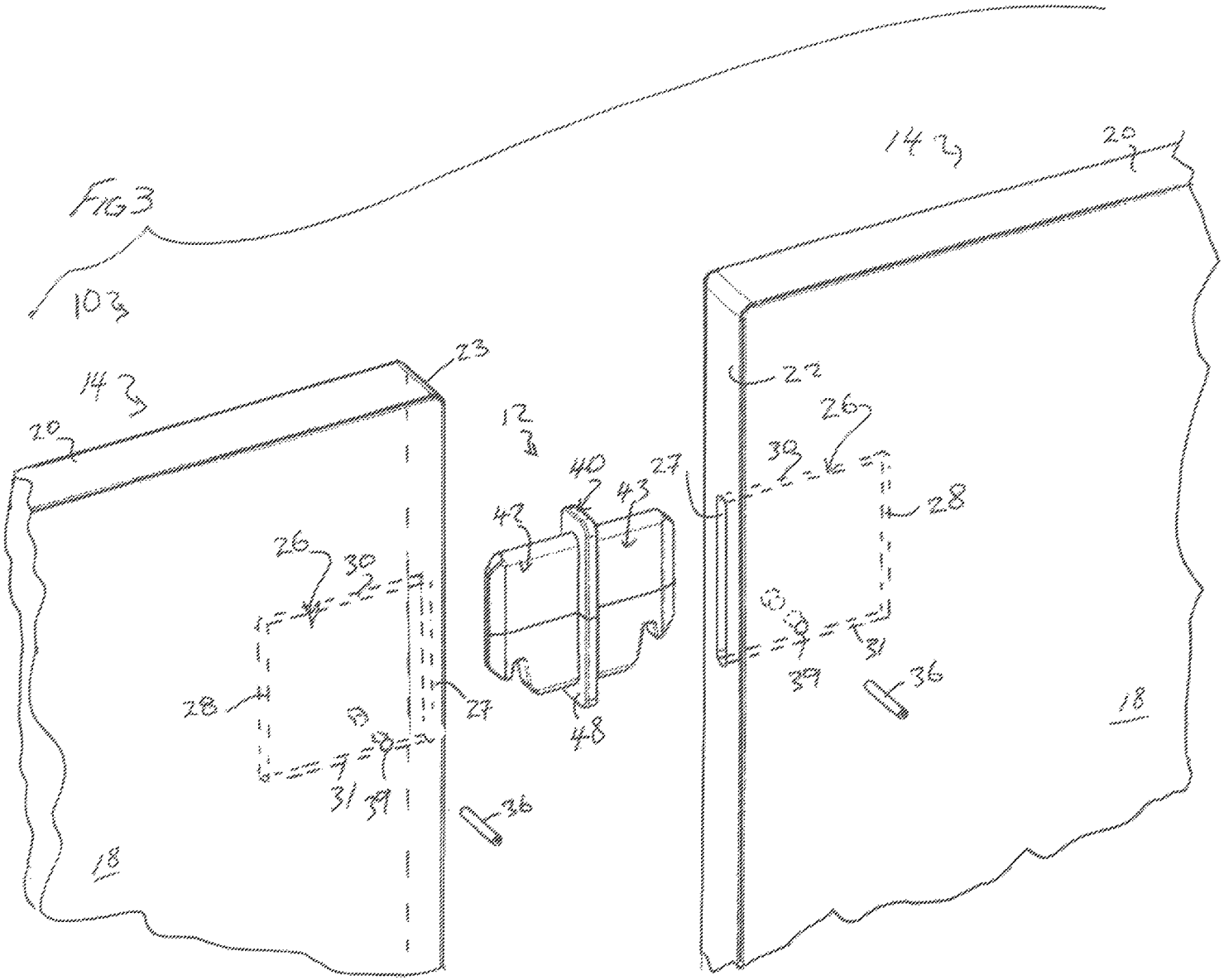
FIG. 3 is an enlarged exploded front perspective view showing the upper corners of the two wall panels of FIG. 2.
Figure 4:
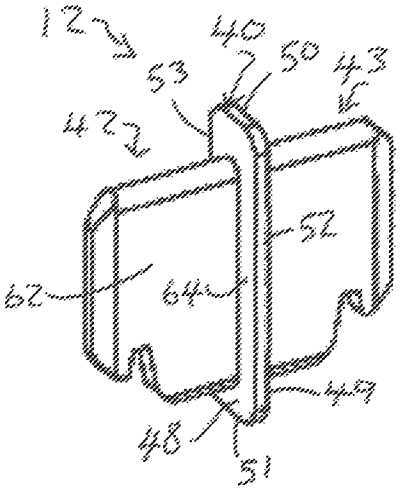
FIG. 4 is a perspective view of the connector shown in FIG. 3.
Figure 7:
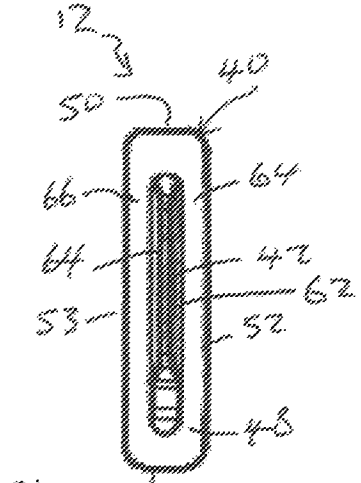
FIGS. 5, 6 and 7 are, respectively, a front elevation view, a top plan view and an end view of the connector shown in FIG. 4.
Figure 6:
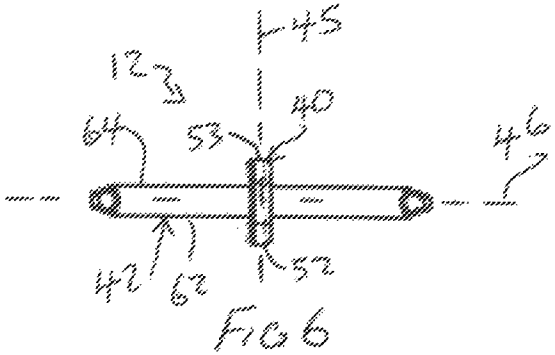
Figure 5:
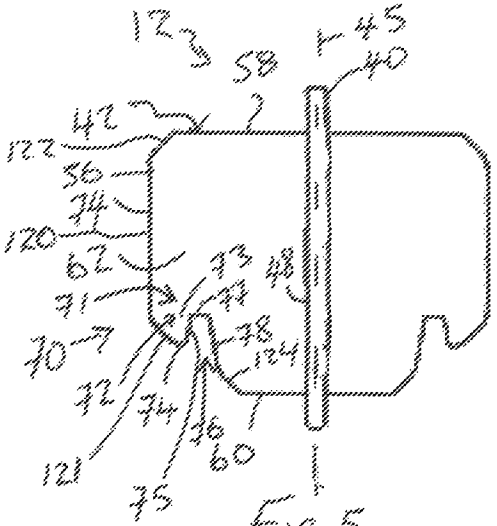
Figure 8:
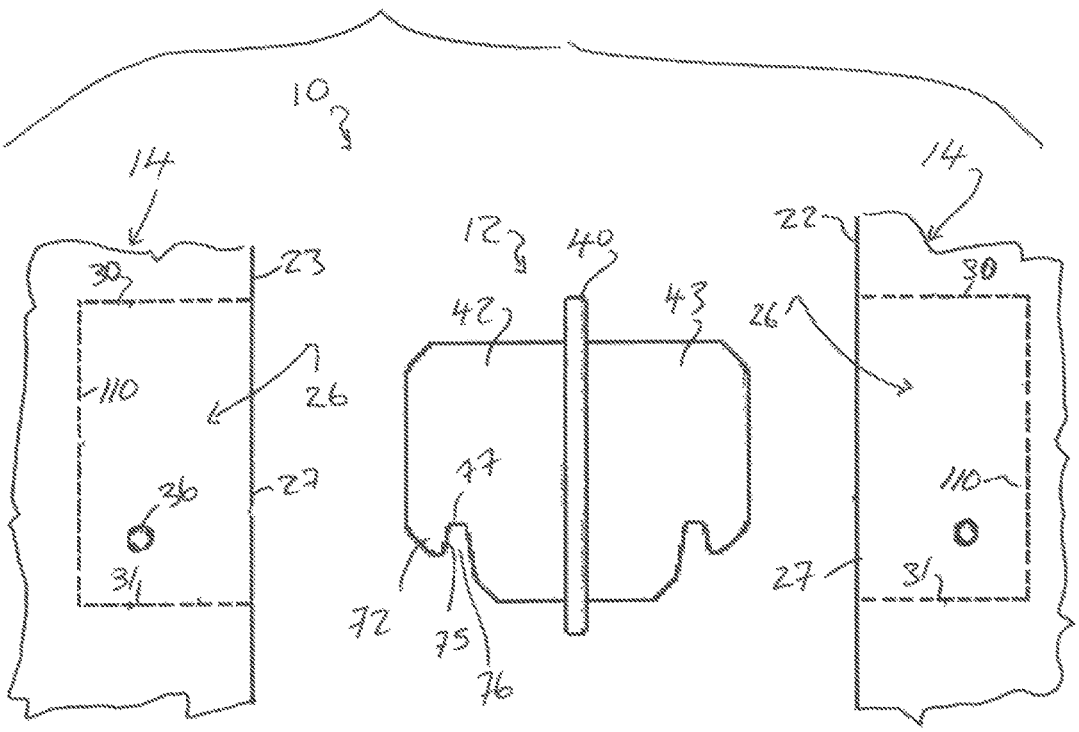
FIG. 8 is a partial front view of FIG. 3.
Figure 9:
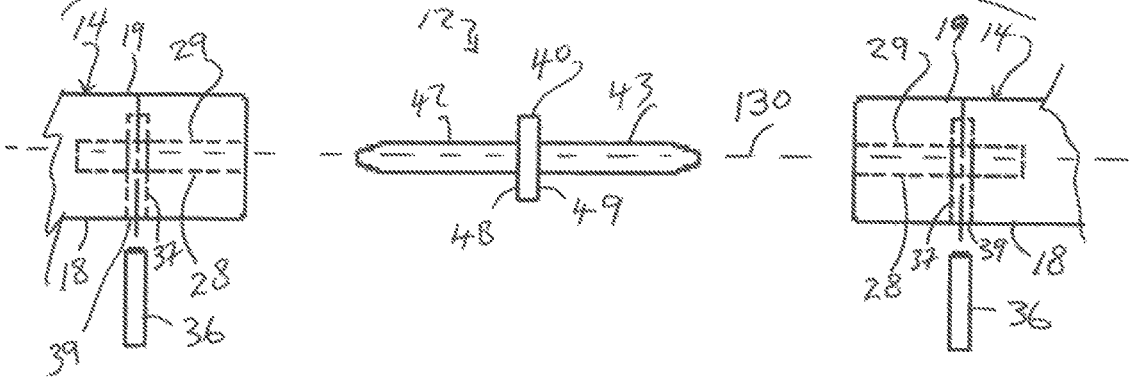
FIG. 9 is a partial top view of FIG. 3.

As can be seen in the Figures and notably in FIG. 3, each wall panel 14 has a slotway 26 that extends horizontally inwardly into the wall panel from a lateral end surface. FIG. 3 illustrates in broken lines a slotway 26 in the left wall panel 14 as extending from the right lateral end surface 23 horizontally to the left. Similarly, in the right wall panel 14, a slotway 26 is shown as extending from the left lateral end surface 22 horizontally towards the right.

Each slotway 26 is open to a lateral end face of the wall panel 14 at a vertical entrance opening 27. Each slotway 26 extends horizontally away from the vertical lateral end face to a blind end 110 as seen, for example, in FIGS. 3 and 8. Each slotway 26 is preferably symmetrical about a vertical central plane 30 vertically through each wall panel 30 shown on FIG. 9. Each slotway 26 is defined between a front slot side wall 28 and a rear slot side wall 29 and between a slot top wall 30 and a slot bottom wall 31.

Each slotway 26 extends from the vertical entrance opening 27 in its respective lateral end surface horizontally inwardly into the wall panel 14 between front face 18 and the rear face 19. Each entrance opening 27 is vertical and extends vertically on the respective lateral end surface and may be considered to extend longitudinally of and vertically of the vertically elongate lateral end surface. The front slot side wall 28 is spaced rearwardly from the front face 18 towards the rear face 19. The rear slot side wall 29 is spaced forwardly from the rear face 19 towards the front face 18. The rear slot side wall 29 is spaced rearwardly from the front slot side wall 28 opposed to the front slot side wall 28. In the preferred embodiment, the front slot side wall 28 and the rear slot side wall 29 are disposed in parallel vertical planes equally spaced from a central vertical plane 130 of the wall panel 14 and provided equidistant between the front face 18 and the rear face 19 as shown on FIG. 9. The slot top wall 30 is downwardly directed and the slot bottom wall 31 is upwardly directed and spaced downwardly from the top wall 30, opposed to the slot top wall 30.

A transverse pin member 36 is provided to span the slotway 26 by extending horizontally across the slotway 26. FIG. 3 shows the two pins 36 in an exploded condition relative to the panels 14. Pin holes 37 are provided horizontally into the wall panel within which the pin members 36 may be secured preferably against removal. The pin holes 37 extend through each slotway 26 transverse to the slotway 26 such that when the pin member 36 is secured in the pin holes 37, each pin member 36 will span the slotway 26 extending from the front slot side wall 28 to the rear slot side wall 29. As can be seen in the exploded top view of FIG. 9, for decorative purposes, each pin hole may extend from an access opening 39 on one of the front and rear faces to a blind end 40 proximate the other of the front and the rear faces such that the access opening 39 to the pin holes and an end of each pin member may merely be seen on the front face and rear face. Each pin member 36 is preferably a cylindrical rod, however, this is not necessary and the pin members and their corresponding pin holes may have various other shapes in cross-section as may be desired.

In the preferred embodiments, each slotway 26 has its slot top wall 30 and slot bottom wall 31 extend horizontally from the entrance opening 27 to the blind end 110, although this is not necessary.

The removable connector 12 is shown in perspective view in FIG. 3 with the two wall panels 14 and also by itself in the perspective, front, top and end views of FIGS. 4 to 7. The connector 12 has a central vertical spacing rib 40 and a pair of identical tongues comprising a first or left tongue 42 and a second or right tongue 43. In the first embodiment of the connector 12 shown in FIGS. 1 to 18, the connector 12 is symmetrical about a vertical transverse plane 45 shown on FIGS. 5 and 6 and is also symmetrical about a vertical longitudinal plane 46 also shown on the plan view of FIG. 6. The transverse plane 45 is normal to the longitudinal plane 46. The spacing rib 40 has a left lateral shoulder surface 48, a right lateral shoulder surface 49, a top surface 50, a bottom surface 51, a front surface 52 and a rear surface 53. The left lateral shoulder surface 48 is disposed in a vertical plane parallel to the transverse vertical plane 45. The right lateral shoulder surface 49 is similarly disposed in a vertical plane parallel to the transverse vertical plane 45. The left lateral shoulder surface 48 is directed towards the left while the right lateral surface 49 is directed towards the right and thus the left lateral shoulder surface 48 is directed away from the right lateral shoulder surface 49.

The left tongue 42 is carried on the left lateral shoulder surface 48. The left tongue 42 extends from a proximate end 54 on the left lateral shoulder surface 48 away from the left lateral shoulder surface 48 to a distal end 56. The left tongue 42 has a top surface 58 and a bottom surface 60. The left tongue 42 includes a forwardly directed front face 62 and a rearwardly directed rear face 64. Each of the front face 62 and the rear face 64 are disposed equally spaced to the front to rear respectively of the longitudinal plane 46. In the preferred embodiment, the front face 62 and the rear face 64 are shown to be flat surfaces disposed in respective planes parallel to the longitudinal plane 46, however this is not necessary. The front to rear thickness of the left tongue 42 is defined by the front to rear spacing between the front face 62 and the rear face 64. As can readily be seen in FIGS. 4, 6 and 7, the left tongue 42 has a front to rear thickness which is less than the front to rear thickness of the spacing rib 40 such that as shown on FIG. 7, a front lateral portion 64 of the left lateral shoulder 48 of the spacing rib 40 extends forwardly beyond the front face 62 and a rear lateral portion 66 of the left lateral shoulder surface 48 of the spacing rib 40 extends to the rear beyond the rear face 64 of the left tongue 42.

The left tongue 42 carries a catch structure 70 for releasable engagement of the pin member 36 at least to prevent the left tongue 42, when inserted into the slotway 26 and moved into a latched position, from being capable of sliding horizontally out from the slotway 26. The catch structure 70 preferably comprises a first hook member 71 having a catch arm 72 that extends downwardly from a proximate end 73 to a lower distal end 74. The catch arm 72 has an outer catch surface 78 located upwardly from the distal end 74 that is directed towards the rib member 40 and, more particularly, in the case of the left tongue 42, towards the left lateral shoulder surface 48. An access bight 76 is defined in part by the outer catch surface 78 with the access bight opening 76 vertically downwardly so as to provide for access by relative vertical sliding of the pin member 36 such that the pin member 36 may relatively slide vertically from below the left tongue 42 upwardly into a position forward of the outer catch surface 78. As seen on FIG. 5, the access bight 76 extends upwardly to a blind end 77 and is defined by the outer catch surface 78, the blind end 77 and an inner catch surface 78.

The catch arm 72 includes an inner surface 120 formed at least near the distal end 74. The inner surface 120 of the catch arm 72 extends away from the spacing rib 40 as it extends upwardly providing a pin cam surface 121 which is adapted, in the event that during sliding insertion of the connector 12 into the slotway 26, that the pin member 36 becomes engaged by the pin cam surface 121 so that the pin cam surface 121 will cam the connector 12 to slide vertically upwardly until the distal end 74 of the catch arm 72 is raised above the pin member 36. At a junction between the top surface 58 and the distal tongue end 56 of the left tongue 42, a bevelled upper slot cam surface 122 is provided which can assist on a user initially inserting the left tongue 42 into the slotway 26 for engagement between the upper slot cam surface 122 and the top slot wall 30 of the slotway 26 to guide the connector 12 downwardly in horizontal sliding of the connector 12 into the slotway 26. Similarly, at a juncture between the inner catch surface 78 and the bottom surface 60 of the left tongue 42, a bevelled lower slot cam surface 124 is provided for engagement on insertion of the connector 12 horizontally into the slotway 26 for possible engagement with the slot bottom wall 31 of the slotway 26 to urge the connector 12 upwardly into the slotway 26 with horizontal sliding of the connector 12 into the slotway 26.

The specific features and elements of the left tongue 42 have been described. The right tongue 43 is a mirror image of the left tongue 42 and for simplicity of illustration, its elements will be described using the same reference numerals as with the left tongue 42, however, qualified merely as necessary by indicating whether any element is for the left tongue 42 or the right tongue 43.

The method of using the removable connector 12 in conjunction with the wall panels 14 and the relative movement and juxtaposition of the connector 12 and the panels 14 are now described notably with reference to FIGS. 10 to 18.

Figure 10:
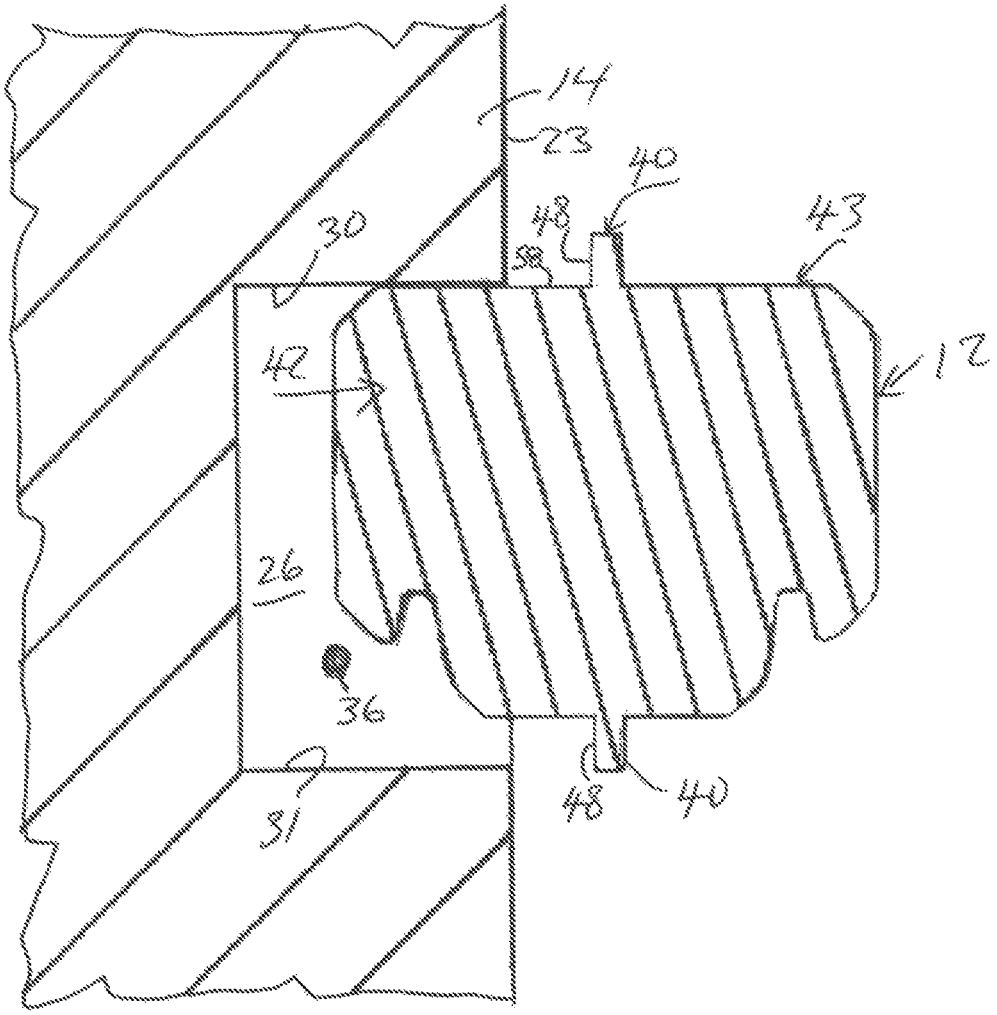
FIG. 10 is a partial vertical cross-sectional front view centrally through the left hand panel shown in FIG. 3 illustrating the connector of FIG. 3 as being initially inserted into a slotway of the left hand wall panel.

FIGS. 10 to 13 as well as 17 and 18 illustrate vertical cross-sectional views through the wall panels 14 along a center axis 30 with the connector 12 disposed such that its longitudinal plane 46 is coplanar with the central axis 30. FIG. 10 illustrates a condition in which the connector 12 is located with its left tongue 42 disposed inside the slotway 26 of the left wall panel 14 with its top surface 58 in engagement with the slot top wall 30 of the slotway 26 and from which position by horizontal sliding of the connector 12, the connector 12 may either be withdrawn from the slotway 26 or slid horizontally into the slotway.

Figure 11:
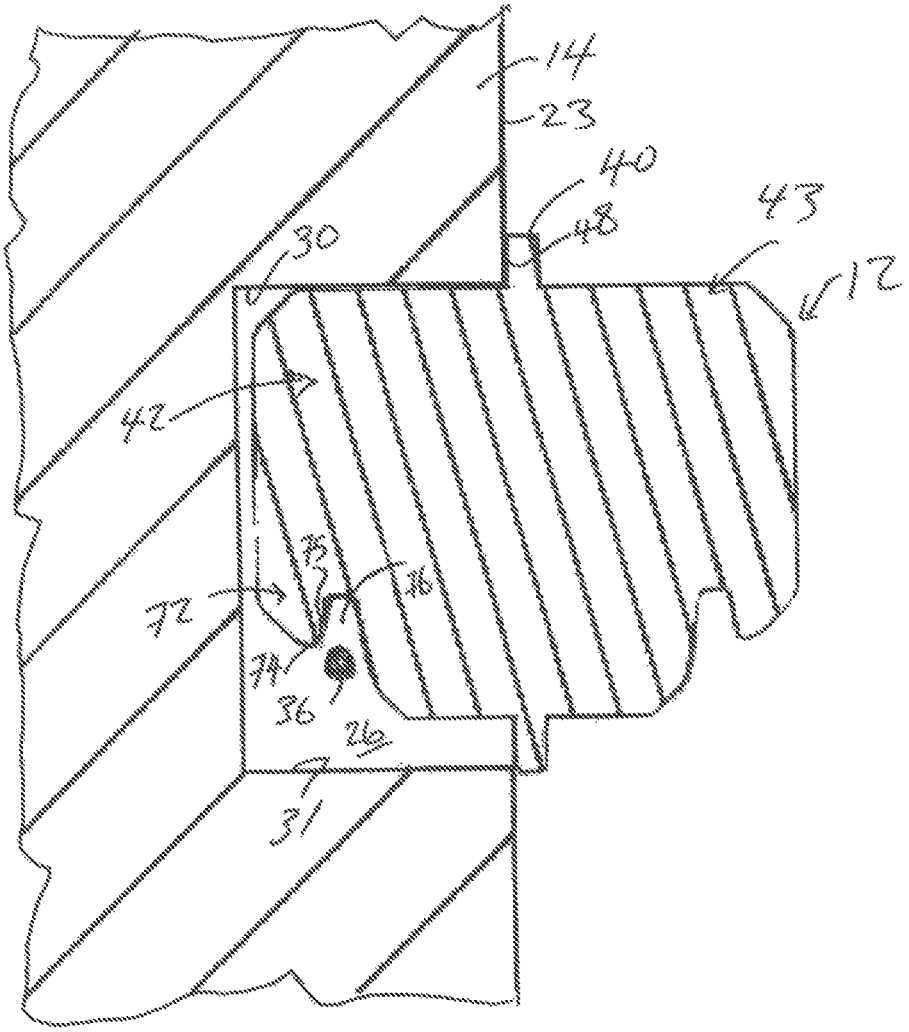
FIG. 11 is a vertical cross-sectional view the same as in FIG. 10, however, showing the connector as moved horizontally to the left until a spacing rib on the connector engages a lateral end surface of the left wall panel.

FIG. 11 is a view the same as FIG. 10, however, showing the connector 12 as having been slid horizontally from the position of FIG. 10 to a position in which the spacing rib 40 engages the right lateral end surface 23 of the left wall panel 14. Thus, as seen in FIG. 11, the left lateral shoulder surface 48 of the spacing rib 40 engages the right lateral lower end surface 23 limiting horizontal sliding of the connector 12 towards the left in what is defined as an unlatched position. In this unlatched position, the pin member 36 is located at a height below the distal end 74 of the catch arm 72 and vertically relatively forwardly of the outer catch surface 78. The pin member 36 may be seen to be vertical below the access bight 76 in vertical alignment.

Figure 12:
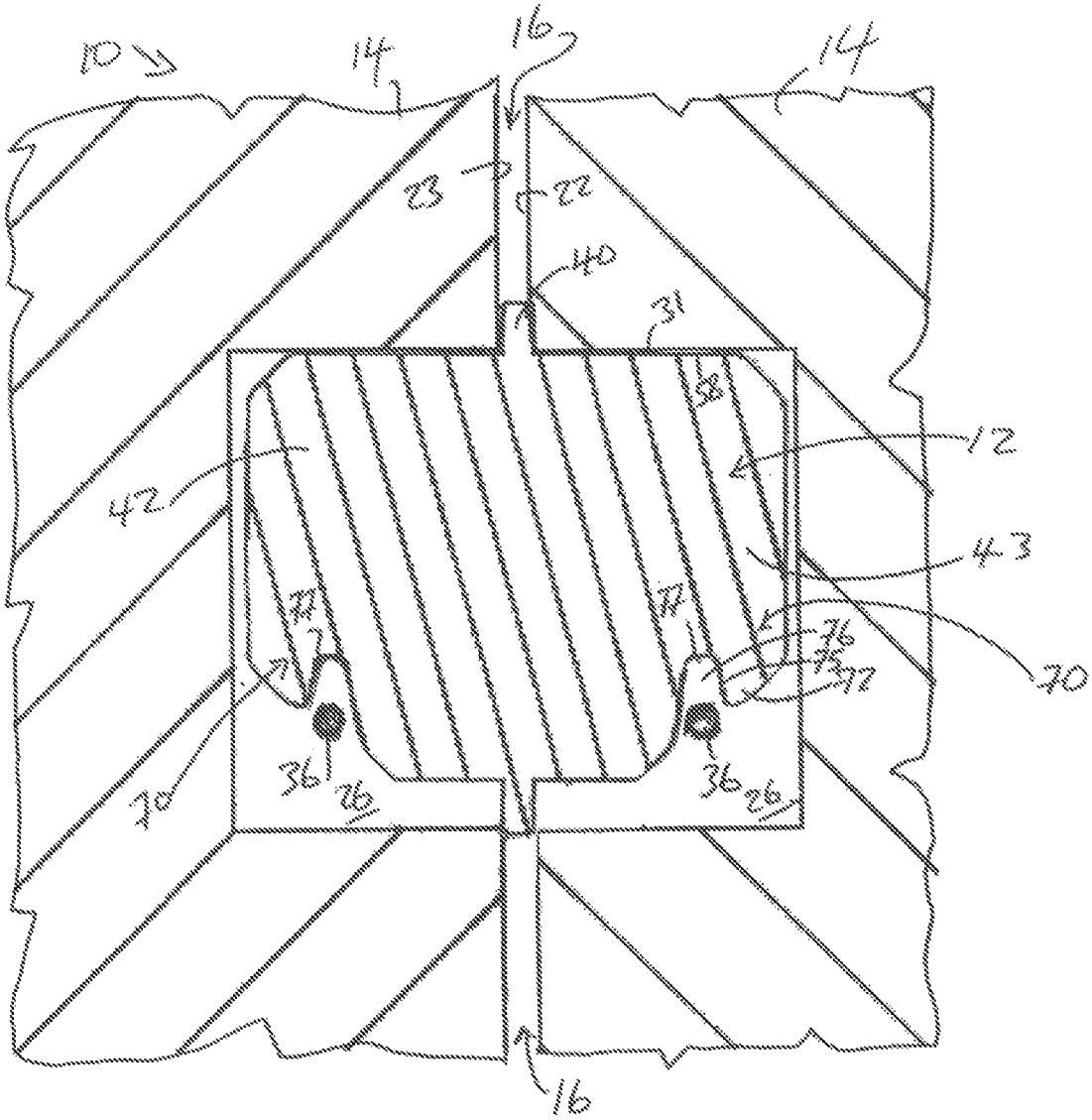
FIG. 12 is a vertical cross-section view the same as FIG. 11, however, also showing a right hand wall panel in engagement with the spacing rib of the connector.

FIG. 12 illustrates the situation which arises when the left hand panel 14 with the connector 12 in the condition as shown in FIG. 11 are relatively moved horizontally relative the right hand panel 14 so as to achieve a similar inserted unlatched position of the right tongue 43 of the connector 12 within the slotway 26 of the right wall panel 14. As seen in FIG. 12, the horizontal sliding of the right tongue 43 into the slotway 26 of the right panel 14 is stopped by the engagement of the spacing rib 40, that is, the right lateral shoulder surface 49 of the spacing rib 40 with the left lateral end surface 22 of the right wall panel 14. The top 58 of the right tongue 43 is shown as engaged with the top wall 31 of the slotway 26 of the right wall panel 14. The pin member 36 of the right wall panel 14 is disposed at a height below the height of the catch arm 72 of the right tongue 43 and the pin member 36 is relatively vertically located to the left of the outer catch surface 78 of the catch arm 72 of the right tongue 43 such that the pin member 36 is below and in vertical alignment with the access bight 76 of the right tongue 43.

Figure 13:
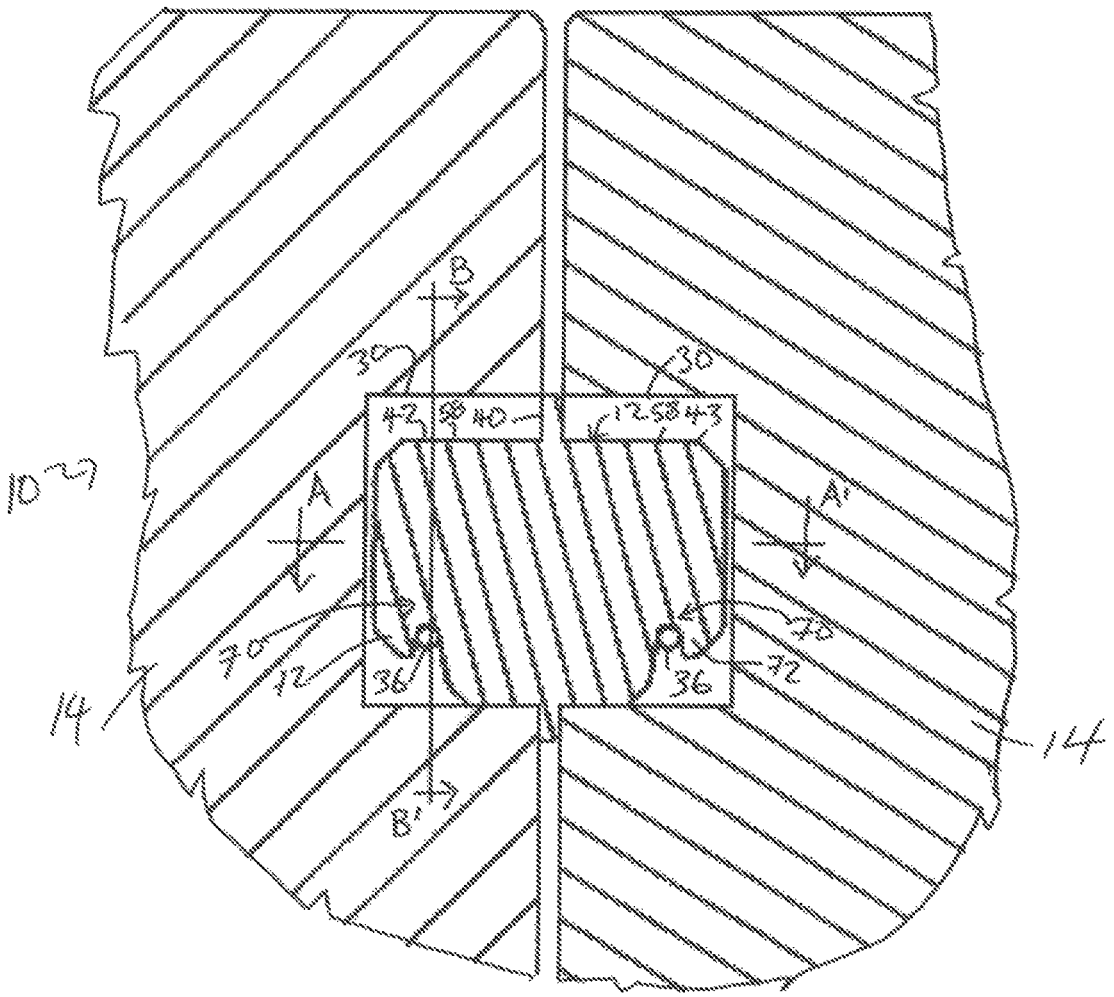
FIG. 13 illustrates a vertical cross-sectional view the same as in FIG. 12, however, with the connector having been moved vertically downward relative both of the wall panels to a latched position with a pin member of each wall panel being engaged to the connector; and with FIG. 13 also representing vertical cross-sectional view through the wall panels and connector as seen in FIG. 2.

FIG. 12 illustrates a condition in which both the left tongue 42 and the right tongue 43 are in the inserted unlatched position relative to the respective left wall panel 14 and right wall panel 14. As can be seen in FIG. 12, the right lateral end surface 23 of the left wall panel 14 is opposed to and spaced from the left lateral end face 22 of the right wall panel 14 by the vertical space 16 representing at least the width of the spacing rib 40. The vertical space 16 provides for access to the spacing rib 40 and, preferably, to its top surface 50 to apply downwardly directed forces to the connector 12 to slide the connector 12 vertically downwardly relative to the two wall panels 14 whereby with such relative vertical movement, the pin members 36 come to be engaged by the catch structures 70 as seen in FIG. 13. In this regard, the outer catch surface 78 on each of the tongues 42 and 43 engages the respective pin member 36 so as to receive the pin member 36 in the catch structure 70. In this regard, on vertical downward sliding, each pin member 36 comes to slide vertically into the access bight 76 to become engaged with each of the outer catch surface 78, upper blind end 77 of the access bight 764 and the inner catch surface 78 as seen in FIG. 13.

FIG. 13 shows these conditions in which each of the left tongue 42 and right tongue 43 of the connector 12 are in a latched position in which engagement between each pin member 36 and the catch structure 70 of each tongue prevents horizontal sliding of the connector 12 relative to their respective wall panels. Uncoupling of the connector 12 to the wall panels 14 reverses the steps involved in coupling. For uncoupling from the latched positions of FIG. 13, the connector 12 is slid vertically upwardly relative to each of the wall panels 14. Sliding of the connector 12 upwardly relative to the wall panels is permitted by a user accessing the spacing rib 40 via the vertical space 16 between the spaced lateral ends of the wall panels 14 and applying forces to slide the connector 12 vertically upwardly until the distal end 74 of each of the catch arms 72 is raised to a height above the height of an upper surface of the pin member 36. For example, this may preferably be accomplished by sliding the connector 12 upwardly until the top surface 58 of each of the tongues 42 and 43 engages the slot top wall 30 of each of the slotways 26. From the position of FIG. 12, each of the wall panels 14 may be slid horizontally relative to the connector 12, for example, passing to the position of FIG. 10 and subsequently removing the connector 12 from the slotways 26 as desired.

Figure 14:
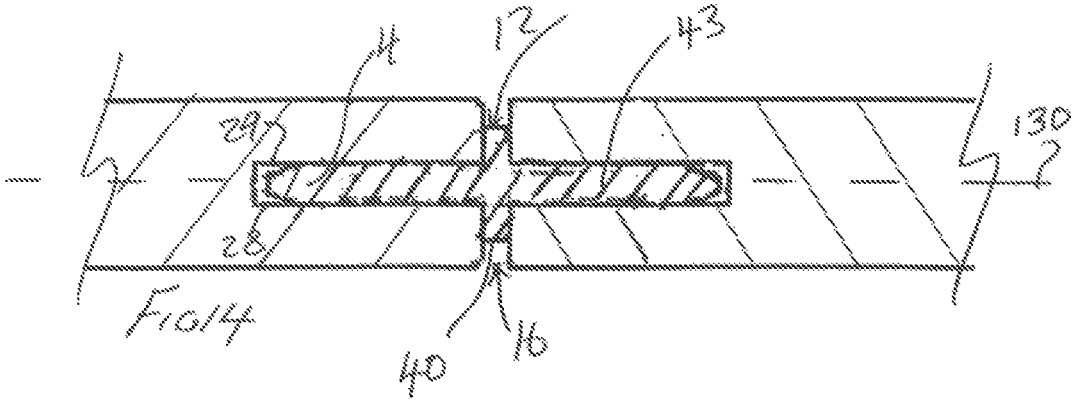
FIG. 14 comprises a horizontal cross-sectional view along section line A-A' in FIG. 13.
Figure 15:
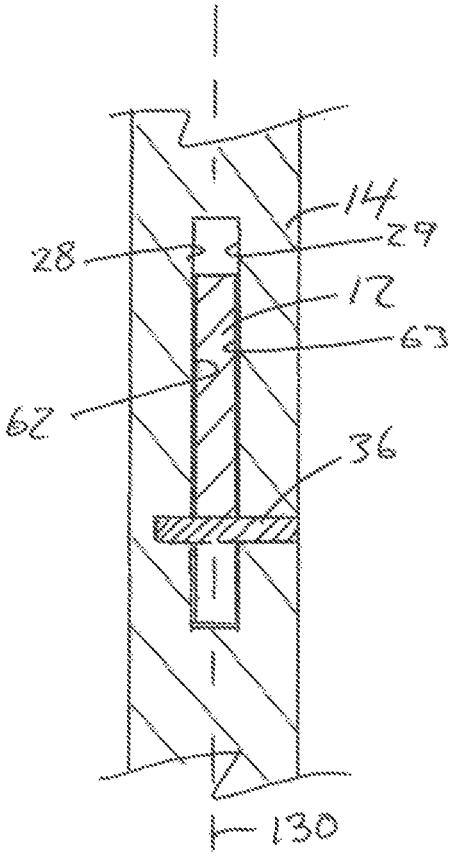
FIG. 15 comprises a vertical cross-sectional view along section line B-B' in FIG. 13.
Figure 16:
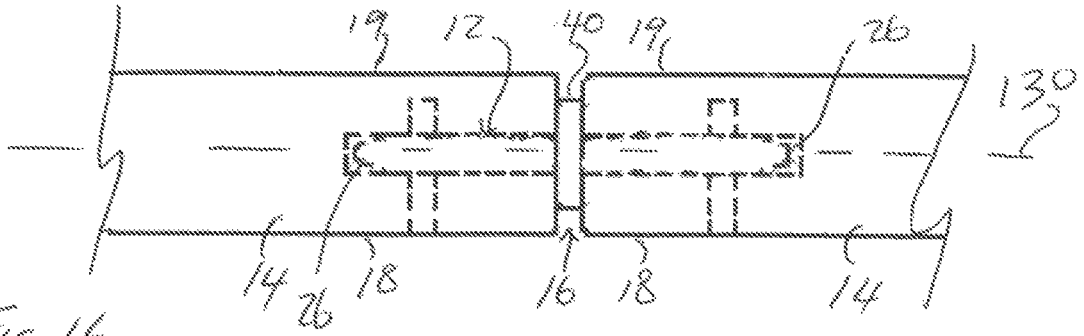
FIG. 16 is a partial top view of the two wall panels as connected in FIG. 2.
Figure 17:
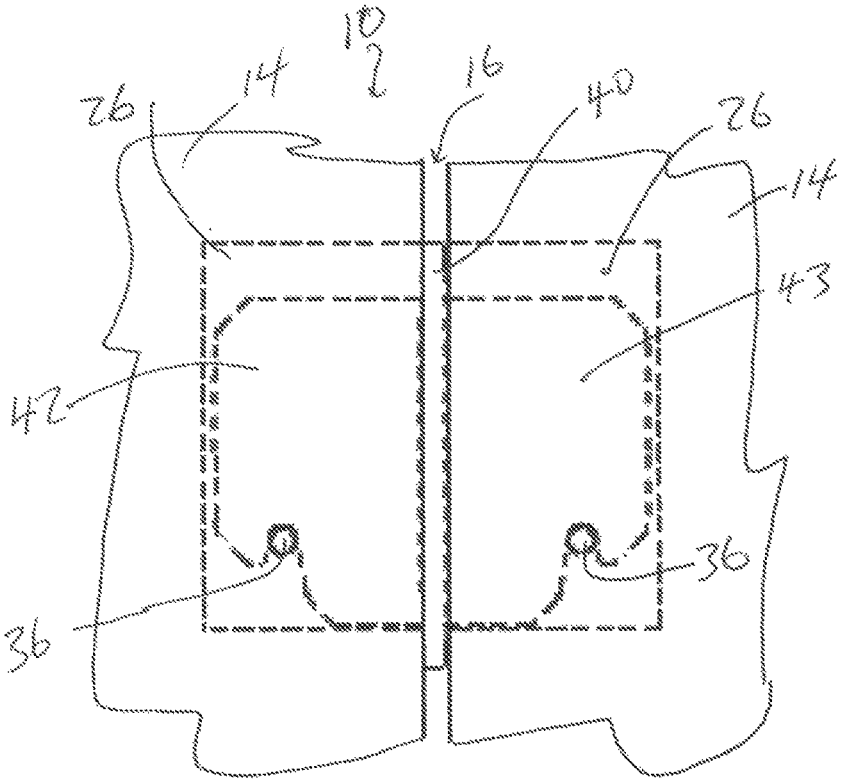
FIG. 17 is a partial front view of the two wall panels as connected in FIG. 2.

Reference is made to FIGS. 14 and 15 which illustrate a top view in horizontal cross-section through FIG. 13 with the connector 12 in the latched position relative to both the wall panels. As can be seen in FIG. 15, the front to back width of each of the left tongue 42 and right tongue 43 correspond closely to the front to back width of each slotway 26. As seen in FIGS. 14 and 15, the front face 62 and the rear face 64 of each of the tongues 42 and 43 are in close engagement with the front slot side wall 28 and the rear slot side wall 29 of each slotway 26 as can be of assistance in preventing front to rear movement of each tongue relative to each wall panel and in maintaining the right wall panel 14 and the left wall panel disposed in alignment about common vertical center planes 130.

Preferably, the catch structure 70 is structured such that outer catch surface 78 of each catch arm 72 engages an inner surface of the pin member 36 so as to draw the adjacent lateral shoulder surface of the spacing rib 40 into close engagement and vertical alignment with the lateral end surface of the respective wall panel 14 within which each tongue is received. For example, the outer catch surface 78 on the left tongue 42 is directed towards the right towards the central rib 40 and is adapted to engage an inner or left surface of the pin member 36 that is directed horizontally to the left so as to draw the left lateral shoulder surface 48 of the spacing rib 40 towards the left into engagement with the right lateral end surface 23 of the left wall panel 14, preferably, adopting a friction-fit which provides at least some initial resistance to vertical sliding of the connector 12 upwardly from the unlatched position.

As can be seen, for example, in FIG. 11, the outer catch surface 78 of the left tongue 42 extends outwardly of the slotway 26, that is, towards the right as the outer catch surface 78 extends upwardly. This outer catch surface 78 is preferably disposed at an angle to the vertical such that prior to the pin member 36 becoming received within the blind end 77 of the bight 76 forces will come to be applied between the inner surface of the pin member 36 and the outer catch surface 78 which will attempt to draw the spacing rib 40 into the right lateral end surface 23 of the left wall panel 14. In the preferred embodiment as illustrated, for example, in FIG. 13, in the latched position, each pin member 36 is engaged within the blind end 77 of the access bight 76 constrained against movement vertically downwardly as well as horizontally either to the left or to the right relative to its respective tongue. This can be advantageous to provide coupling between the two wall panels which reduces any relative movement of the three elements of the connector 12 and the two wall panels 14.

Figure 18:
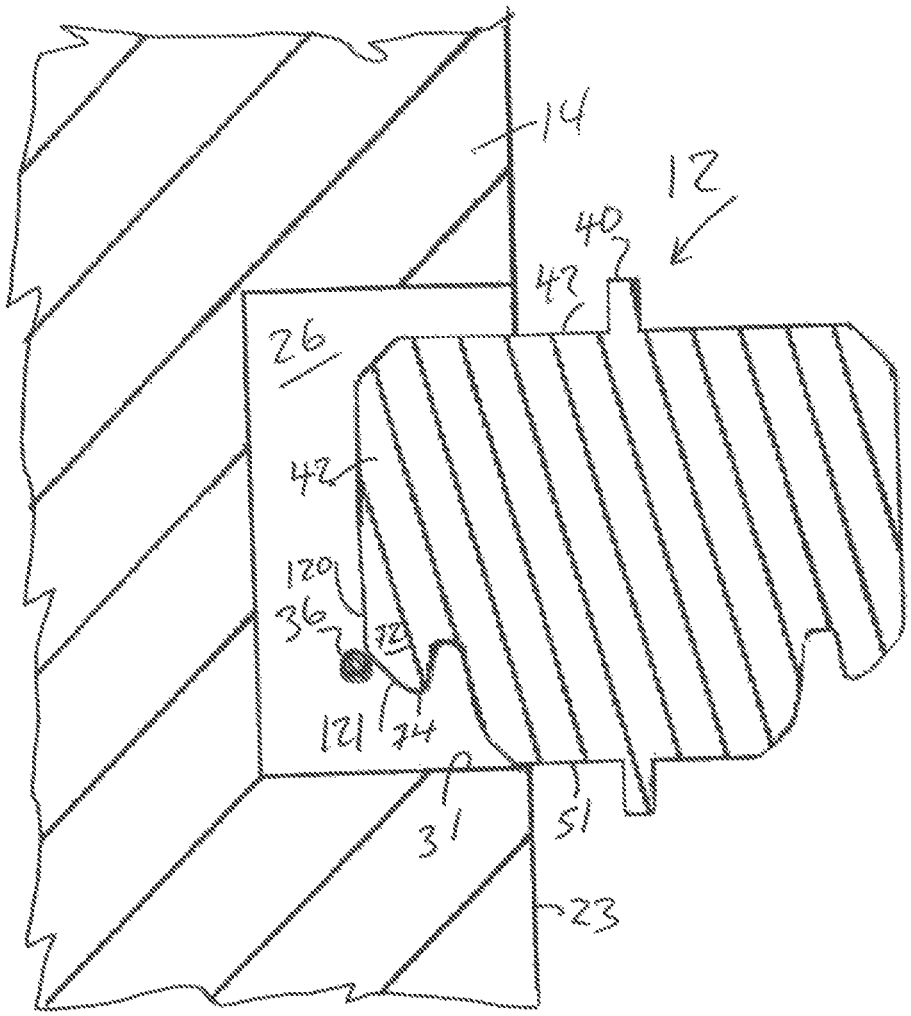
FIG. 18 shows a vertical cross-sectional front view the same as FIG. 10, however, showing the connector inserted into the slotway of the left hand wall panel in a vertically lower position than in FIG. 10 with the pin member engaging a pin camming surface on the connector.
Figure 19:
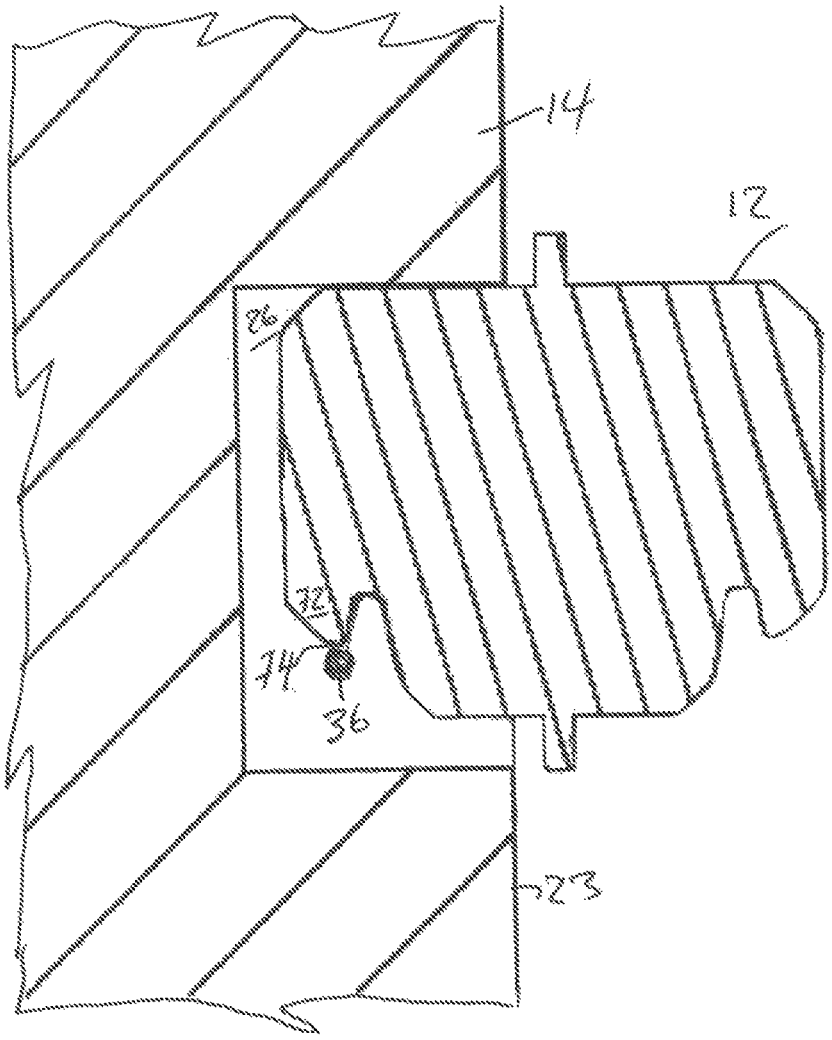
FIG. 19 shows a vertical cross-sectional front view the same as that shown in FIG. 18, however, in which the connector has been moved to the left relative to the position of FIG. 18 with the pin camming surface vertically above the pin member and from which position the connector can be moved further to the left to assume the position shown in FIG. 11.

Reference is made to FIGS. 18 and 19 which illustrate the interaction of the pin cam surface 121 and the pin member 36. FIG. 18 represents a condition in which the connector 12 is being inserted into the slotway 26 with the bottom surface 51 of the left hand tongue 42 sliding on the slot bottom wall 31 of the slotway 26. On sliding of the connector 12 to the left as shown, the distal end 74 of the catch arm 72 is located at a height below the height of the pin member. The surface 120 of the catch arm 72 and notably the pin cam surface 121 engages an outer surface of the pin member 36 as shown in FIG. 18. Due to the disposition of the pin cam surface 121 at an angle to the vertical, on sliding the connector 12 horizontally towards the left, the engagement between the pin cam surface 121 and the pin member 36 will slide the connector 12 in a camming action vertically upwardly to reach the position as shown in FIG. 19 in which the distal end 74 of the catch arm 72 is at a height above the height of the pin member 36 whereupon the connector 12 may then be further slid horizontally to the inserted unlatched position as in FIG. 11.

The first preferred embodiment has been described and illustrated in an arrangement in which the connector 12 assumes the inserted unlatched position above the pin members 36 and to move to the latched position connector 12 is moved vertically downwardly. However, as an alternate arrangement, consider as, for example, if the embodiments of FIGS. 10 to 13 were effectively inverted, then an arrangement would be provided in which movement from the inserted unlatched position to the latch position would be a relative vertical sliding of the connector relative to the two end panels.

Figure 21:
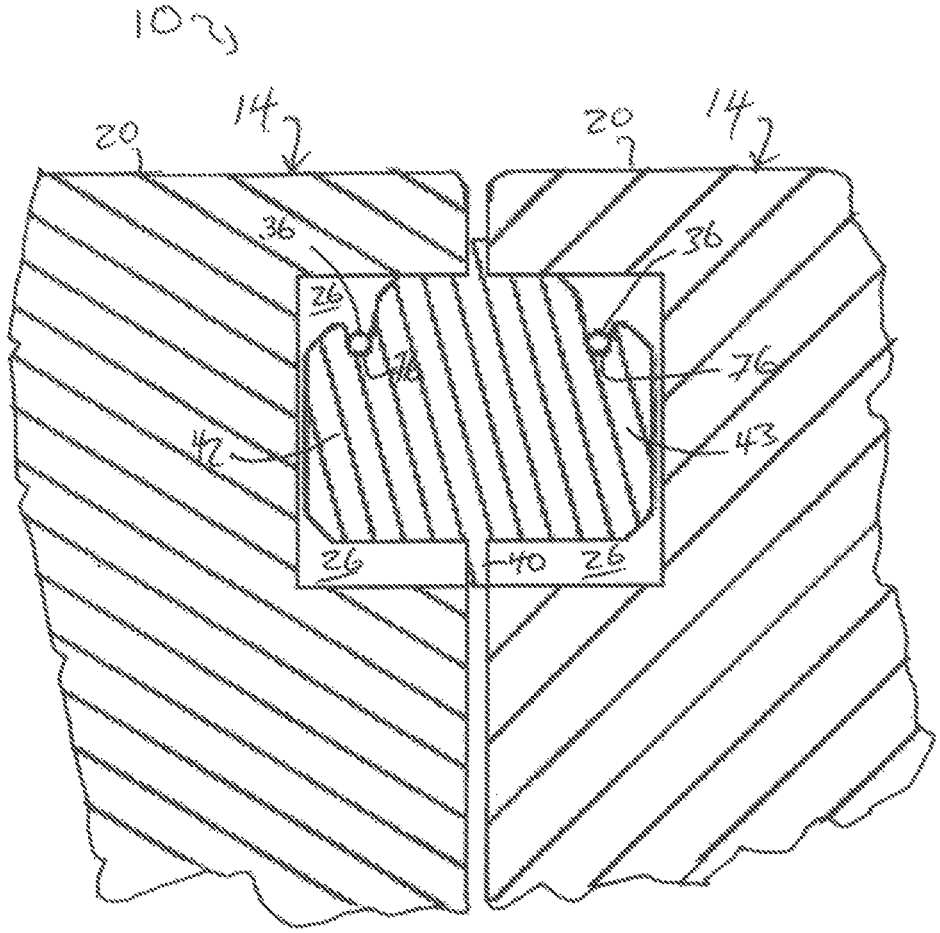
FIG. 21 is a vertical cross-sectional view the same as FIG. 13, however, of a second embodiment in accordance with the present invention.

FIG. 21 which is substantially the same as FIG. 13 shows such an alternate second embodiment identical to that shown in FIG. 13, however, in which the pin members 36 are located relative the slotways 26 to be above the connector 12, that is, above the access bights 76 which open upwardly and movement of the connector 12 to the latched position shown in FIG. 21 is by vertical movement upwardly.

In accordance with the first embodiment of the present invention, each slotway 26 is defined between a front slot side wall 28 and a rear slot side wall 29, each of which is preferably parallel to the vertical central plane 30. Similarly, each of the left tongue 42 and the right tongue 43 defined between a front face 52 and a rear face 53, each of which is disposed in a vertical longitudinal plane 46 that on insertion into the slotways 26 assumes a position with the plane 46 coplanar with the central vertical plane 30. In accordance with the present invention, the front to rear dimension of the slot may vary or the front to rear dimension of the tongue may vary, for example, to provide some reduction of front to rear dimension of slotway 26 or a tongue with increased distance from the entrance opening 27 or the spacing rib 40. Preferably, the relative front to rear width of the slotway 26 in the latched position provides for complementary engagement with the front face and the rear face of the tongues to prevent relative front to rear movement of each tongue and its complementary slotway. In this regard, it is to be considered that as seen in any vertical cross-section when in the latched position, the front to rear width and profile of the slotway will match the front to rear width and profile of the tongue received in the slotway.

Figure 22:
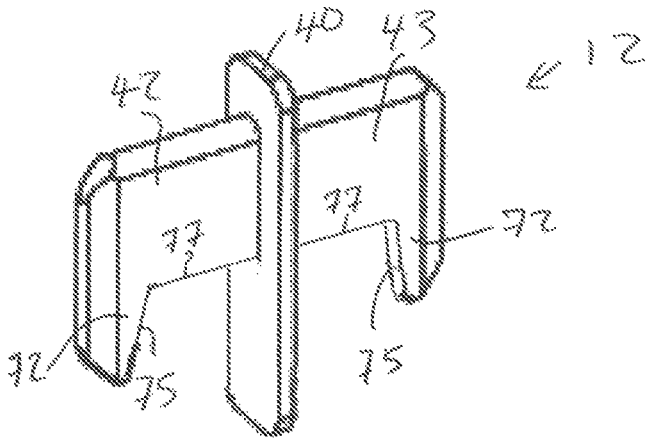
FIG. 22 is a perspective view of a connector in accordance with a third embodiment of the present invention.
Figure 23:
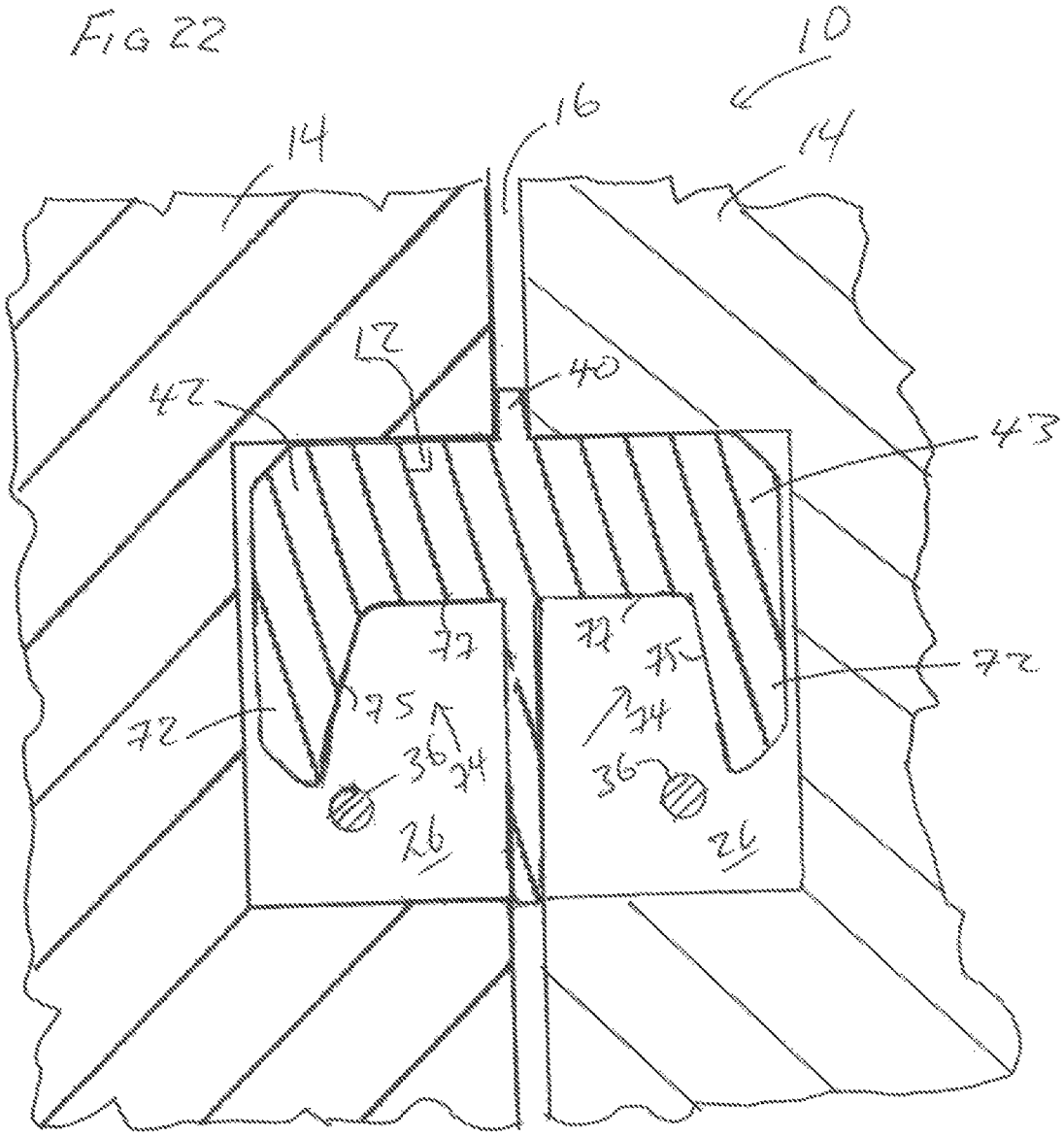
FIG. 23 is a vertical cross-sectional side view similar to FIG. 11 but showing the third embodiment with a connector shown in FIG. 22.
Figure 24:
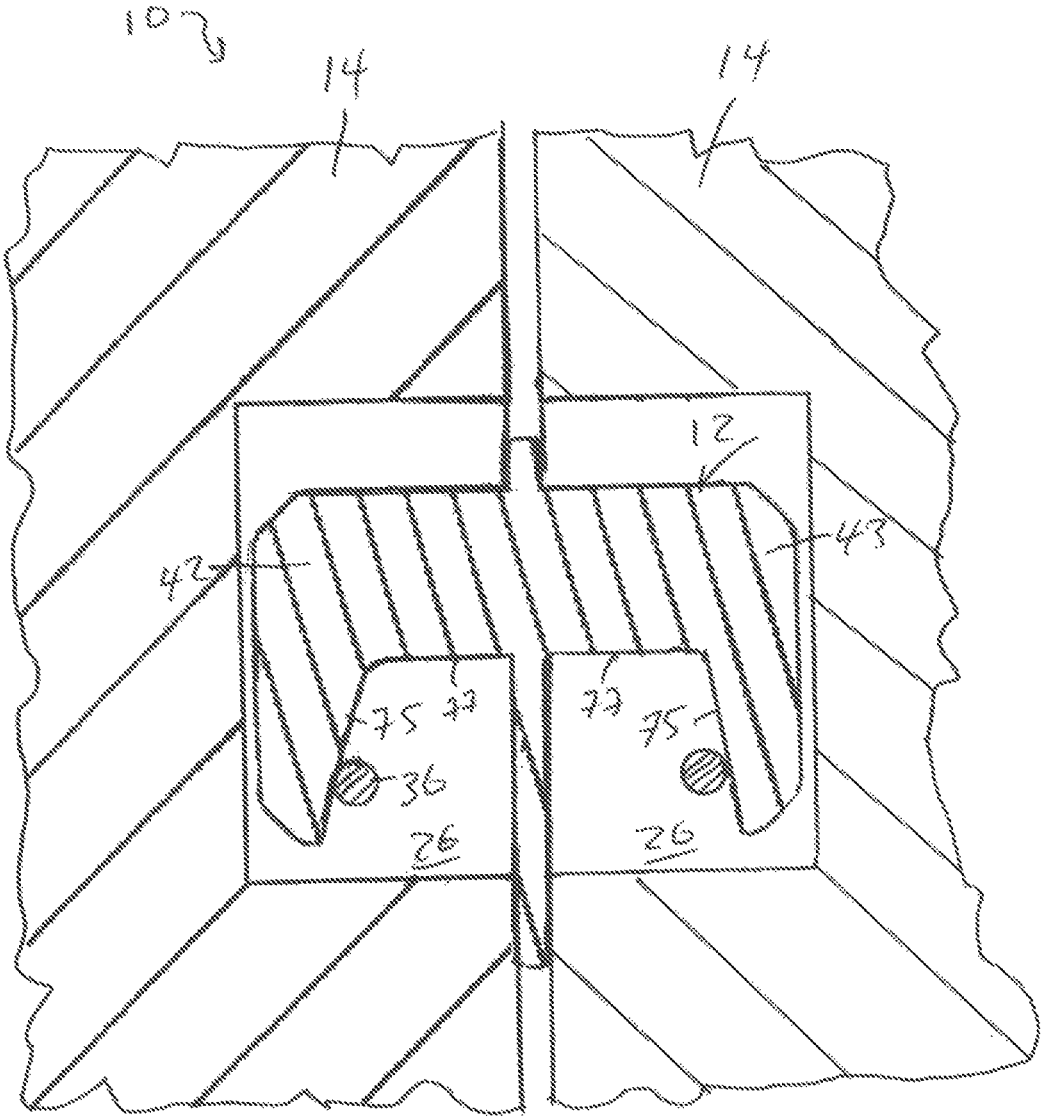
FIG. 24 is a vertical cross-sectional side view similar to FIG. 13 but showing the third embodiment with the connector shown in FIGS. 22 and 23.

Reference is made to FIGS. 22, 23 and 24 illustrating a third embodiment in accordance with the present invention. FIG. 22 is a perspective view of a connector 12 in accordance with the third embodiment of the present invention which is substantially identical to the connector 12 of FIG. 4, however, with a notable exception that a lower portion of each of the tongues 42 and 43 of FIG. 4 has been cut away laterally between the catch arm 72 and the spacing rib 40 to provide as in FIG. 22 an access bight 76 with a blind end 77 as a directed surface which extends from an outer end merging with the outer catch surface 78 to the spacing rib 40. As well, as compared to that of the first embodiment as in FIG. 4, in FIG. 23, the blind end 77 of the access bight 77 is located further vertically upwardly than in FIG. 4.

FIG. 23 illustrates the tongues 42 and 43 of the connector 12 in inserted unlatched positions with the access bights 76 vertically above the pin members 36. From the portion of FIG. 23, the connector 12 is moved vertically downward so that the pin members 36 become engaged by the inner catch surfaces 75 on the catch arms 72 and assume the latched position shown in FIG. 24.

Referring to FIG. 24, shown in the latched position, the vertical downward sliding of the connector 12 is limited by the engagement between each pin member 36 and the outer catch surface 78 on the catch arm. This is to be contrasted with the situation of the first embodiment in which the vertical downward sliding of the pin member 36 is limited not only by the engagement of the pin member 36 with the blind end 77 of the access bight 76 but also by the engagement of each slot bottom wall 31 and each bottom surface 60 of each slotway 26. However, with the third embodiment, as seen in FIG. 24, the vertical downward movement is shown as being limited merely by the engagement of the pin members 36 with the catch arms 72 without the pin moving into engagement with the blind end 77. The arrangement shown in FIG. 24 can be advantageous so as to better adapt for inaccuracies in the manufacture of the panels 14, particularly the slotways and the relative location of the pin members of the connectors so as to better accommodate variances in any of the dimensions to provide on vertical downward sliding the lateral shoulder surfaces of the spacing rib to be drawn into frictional engagement with the lateral end surface of the wall panels.

In the first embodiment as shown in FIG. 13, vertical downward movement of the connector 12 is limited both by the engagement of the blind end 77 of the access bight 76 and the pin members 36 and the engagement of the slot bottom wall 31 of the slotway with the bottom surfaces 60 of the tongues. Only one such engagement is necessary although both may be provided.

Figure 25:
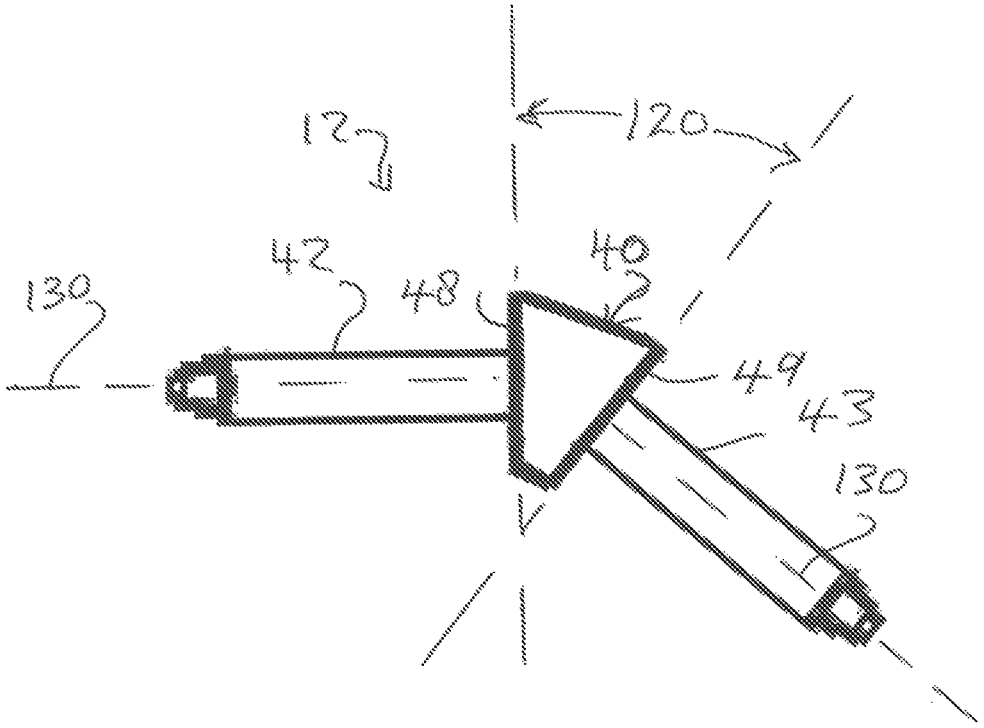
FIG. 25 is a top plan view of a connector in accordance with a fourth embodiment of the invention.

Reference is made to FIG. 25 which illustrates a top view of a fourth embodiment of the present invention. FIG. 25 is a plan view the same as FIG. 9, however, illustrating an arrangement in which a connector is to connect two panels to be disposed with the respective central plane 30 of each panel intersecting at an angle to the other. Connector 12 is identical to the connector illustrated in the first embodiment of FIGS. 1 to 18, however, the spacing rib 40 as seen in top view is wedged shaped so as to provide the left lateral shoulder surface 48 to be disposed in a vertical plane angle 140 to a vertical plane in which the right lateral shoulder surface 49 is disposed thereby disposing the left panel 14 and the right panel 14 to be at corresponding angles to the angle 120. The manner of coupling and uncoupling of the connector 12 of the fourth embodiment is the same as in the first embodiment.

Angle 120 may comprise any desired angles such as 30 degrees, 60 degrees or 90 degrees. Within each case, a suitable space is to be provided by the spacing rib 40 between the adjacent ends of the wall panels 14 for access to vertically slide the connector 12 relative the wall panel.

Figure 20:
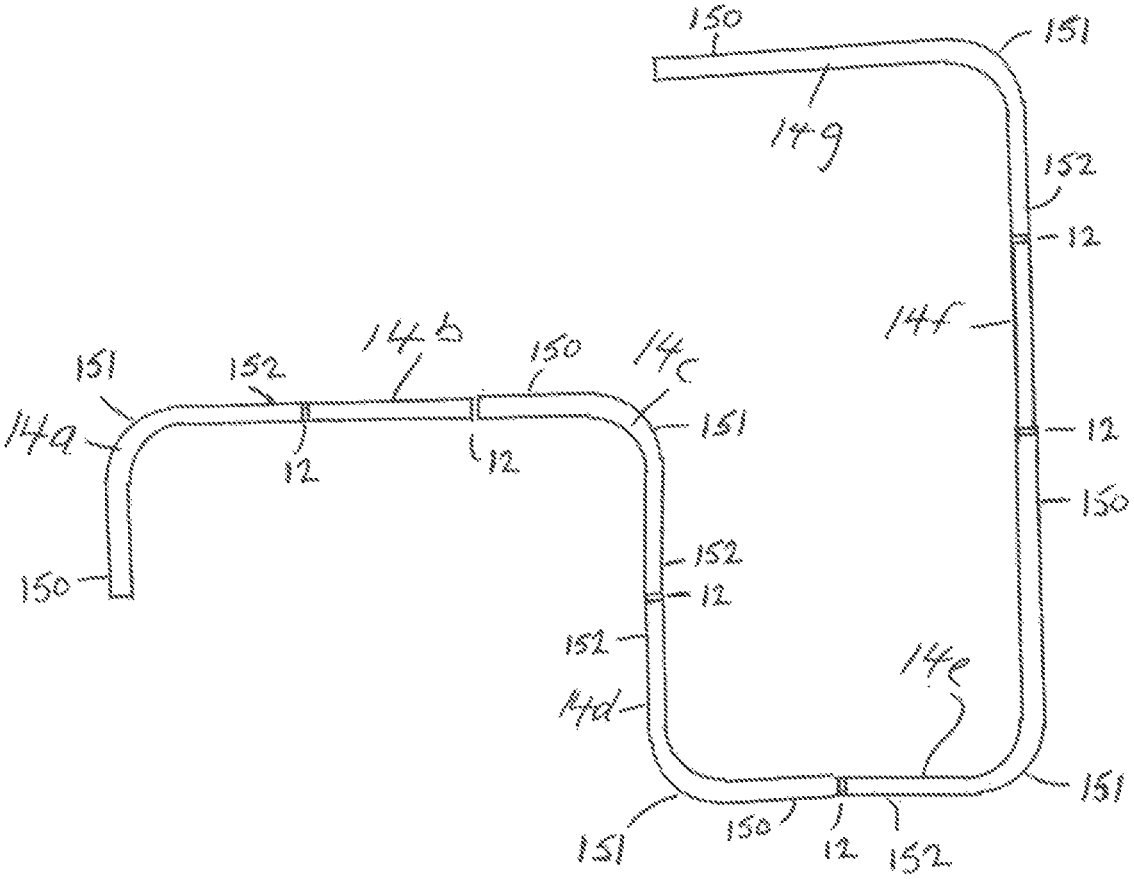
FIG. 20 is a top plan view illustrating an arrangement for dividing an office space using a plurality of wall panels which are connected end-to-end using a connector system in accordance with the present invention.

Reference is made to FIG. 20 which illustrates a plan view with a plurality of wall panels 14 arranged end-to-end and connected end-to-end by a connector between the ends of adjacent panels. In FIG. 20, the wall panels are indicated as comprising wall panels 14*a* to 14*g* of which panels 14*b* and 14*f* are shown as being straight panels such as in FIG. 1. The remaining panels are shown to be panels with straight sections 150 and 152 proximate their ends and curved intermediate portions 151. For example, panel 14*a* has a curved intermediate portion 151 located at its middle with two straight end portions 150 and 152 equally disposed at 90 degrees to each other. The panel 14*a* thus will be freestanding on its bottom surface without the need for the side extending support feet as was the case with the engagement feet in FIG. 1. Each of the panels 14*a* to 14*g* are connected with an adjacent panel in a similar manner with the panel of FIG. 1 so as to provide a pleasing space dividing wall stable against tipping over and can define a number of different privacy areas.

In FIG. 20, two different modular panels are used to provide the panels with curved portions and thus using two modular panels for which spaces can be provided. The embodiment of FIG. 20 illustrates the curved panels as having curves at 90 degrees. It is appreciated that the panels may have different curves, for example, at different angles such as 45 degrees, 60 degrees, 120 degrees, 140 degrees and 110 degrees without limitation. A suitable selection of limited number of modular panels is used to provide varying pleasing configurations to resultant wall structure using a plurality of panels. In accordance with the preferred embodiment, the connector 12 may preferably be injection molded from a material such as nylon or alternately die cast as from metal, the particular material from which the connector 12 is formed is not limited.

Connector 12 and its catch arm may be provided from a material which may have some resiliency with the inherent deflection of the catch arm assisting in containing the connector 12 in a friction-fit of the panels in the unlatched condition. This condition for maintaining the connector 12 in the inserted unlatched position can be advantageous such that the connector will remain in the inserted unlatched position when two panels are being moved together with the connector in between and maintain the connector in the uncoupled condition until the connector may be moved vertically downwardly to the latched position.

While the invention has been described with reference to preferred embodiments, many modifications and variations will now occur to persons skilled in the art. For a definition of the invention, reference is made to the following claims.

I claim:

1. A wall panel system, comprising:

a first wall panel having a first front face and a first rear face and first peripheral edges about each of the first front face and the first rear face with the first peripheral edges of the first front face joined to complementary first peripheral edges of the first rear face by first lateral end surfaces including a first panel lateral end surface disposed vertically, a first panel slotway in the first panel extending from a vertical first entrance opening in the first panel lateral end surface horizontally inwardly into the first panel between the first front face and the first rear face of the first wall panel, a horizontal first transverse pin member spanning the first panel slotway extending horizontally across the first panel slotway transverse to the first panel slotway, a second wall panel having a second front face and a second rear face and second peripheral edges about each of the second front face and the second rear face with the second peripheral edges of the second front face joined to complementary second peripheral edges of the second rear face by second lateral end surfaces including a second panel lateral end surface disposed vertically, a second panel slotway in the second panel extending from a vertical second entrance opening in the second panel lateral end surface horizontally inwardly into the second panel between the second front face and the second rear face of the second wall panel;

a horizontal second transverse pin member spanning the second panel slotway extending horizontally across the second panel slotway transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and the rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal end, the first tongue carrying a first catch arm extending downwardly to a first distal end, the first catch arm having a first outer catch surface directed towards the first lateral shoulder surface, the second tongue carried on the second lateral shoulder surface extending away from the second lateral shoulder surface to a second distal end, the second tongue carrying a second catch arm extending downwardly to a second distal end, the second catch arm having a second outer catch surface directed towards the second lateral shoulder surface, the first tongue slidable horizontally relative the first wall panel into the first panel slotway with the first distal end insertable into the first panel slotway above the first transverse pin member until in a first inserted unlatched position the first lateral shoulder surface engages the first panel lateral end surface about the first panel slotway limiting insertion with the first outer catch surface of the first catch arm vertically above the first transverse pin member, the second tongue slidable horizontally relative the second wall panel into the second panel slotway with the second distal end inserted into the second panel slotway above the second transverse pin member until in a second inserted unlatched position the second lateral shoulder surface engages the second panel lateral end surface about the second panel slotway limiting insertion with the second outer catch surface of the second catch arm vertically above the second transverse pin member, with the connector simultaneously in (a) the first inserted unlatched position relative the first wall panel, and (b) the second inserted unlatched position relative the second wall panel, the connector is slidable vertically downwardly to simultaneously (i) engage the first outer catch surface of the first catch arm with the first transverse pin member and assume a first latched position in which engagement between the first transverse pin member and first outer catch surface of the first catch arm prevents horizontal sliding of the connector relative to the first wall panel in a direction that moves the first lateral shoulder surface away from first panel lateral end surface, and (ii) engage second outer catch surface of the second catch arm with the second transverse pin member and assume a second latched position in which engagement between the second transverse pin member and the second outer catch surface of the second catch arm prevents horizontal sliding of the connector relative to the second wall panel in a direction that moves the second lateral shoulder surface away from second panel lateral end surface, with the connector simultaneously in (a) the first inserted unlatched position relative the first wall panel, and (b) the second inserted unlatched position relative the second wall panel, the spacing rib is disposed in the vertical space accessible to a user between the first panel lateral end surface and the second panel lateral end surface for engagement by the user to move the connector vertically relative the first wall panel and the second wall panel, and with the connector simultaneously in (a) the first latched position relative the first wall panel, and (b) the second latched position relative the second wall panel, the spacing rib is disposed in the vertical space accessible to the user between the first panel lateral end surface and the second panel lateral end surface for engagement by the user to move the connector vertically relative the first wall panel and the second wall panel, the first panel slotway defined between a downwardly directed first slot top wall spaced upwardly from the first transverse pin member and an upwardly directed first slot bottom wall spaced downwardly from the first transverse pin member and opposed to the first slot top wall, and the second panel slotway defined between a downwardly directed second slot top wall spaced upwardly from the second transverse pin member and an upwardly directed second slot bottom wall spaced downwardly from the second transverse pin member and opposed to the second slot top wall.

2. A wall panel system as claimed in claim 1 wherein:

the first tongue provides a first access bight defined in part by the first outer catch surface which opens downwardly, in moving the connector between the first inserted unlatched position and the first latched position the first transverse pin member slides vertically relative the connector within the first access bight, the second tongue provides a second access bight defined in part by the second outer catch surface which opens downwardly, in moving the connector between the second inserted unlatched position and the second latched position the second transverse pin member slides vertically relative the connector within the second access bight.

3. A wall panel system as claimed in claim 2 wherein:

the first access bight includes a first blind end wall directed downwardly, the first outer catch surface merges upwardly into the first blind end wall with the first blind end wall extending from the first outer catch surface towards the first lateral shoulder surface, and the second access bight includes a second blind end wall directed downwardly, the second outer catch surface merges upwardly into the second blind end wall with the second blind end wall extending from the second outer catch surface towards the second lateral shoulder surface.

4. A wall panel system as claimed in claim 3 wherein:

in the first latched position, the first blind end wall engages the first transverse pin member preventing vertical downward movement of the first tongue relative the first wall panel, and in the first latched position, the second blind end wall engages the second transverse pin member preventing vertical downward movement of the second tongue relative the second wall panel.

5. A wall panel system as claimed in claim 4 wherein:

the first access bight includes a first inner catch surface directed away from the first lateral shoulder surface and opposed to the first lateral shoulder surface, the first blind end wall merging towards the first lateral shoulder surface into the first outer catch surface which extends vertically downwardly from the first blind end wall, the first access bight defined between the first outer catch surface and the first inner catch surface, and the second access bight includes a second inner catch surface directed away from the second lateral shoulder surface and opposed to the second lateral shoulder surface, the second blind end wall merging towards the second lateral shoulder surface into the second outer catch surface which extends vertically downwardly from the second blind end wall, the second access bight defined between the second outer catch surface and the second inner catch surface.

6. A wall panel system as claimed in claim 5 wherein:

in the first latched position, engagement between the first transverse pin member and the first inner catch surface prevents horizontal sliding of the connector relative to the first wall panel in a direction that moves the first lateral shoulder surface toward the first panel lateral end surface, and in the second latched position, engagement between the second transverse pin member and the second inner catch surface prevents horizontal sliding of the connector relative to the second wall panel in a direction that moves the second lateral shoulder surface toward the second panel lateral end surface.

7. A wall panel system as claimed in claim 1 wherein:

the first panel slotway defined between a first front slot sidewall spaced rearwardly from the first front face towards the first rear face and a first rear slot side wall spaced forwardly from the first rear face towards the first rear front face, the first rear slot side wall spaced from the first front slot side wall and opposed to first front slot side wall, the horizontal first transverse pin member spanning the first panel slotway extending horizontally across the first panel slotway transverse to the first panel slotway from the first front slot side wall to the first rear slot side wall, the second panel slotway defined between a second front slot side wall spaced rearwardly from the second front face towards the second rear face and a second rear slot side wall spaced forwardly from the second rear face towards the second front face, the second rear slot side wall spaced from the second front slot side wall and opposed to second front slot side wall, the horizontal second transverse pin member spanning the second panel slotway extending horizontally across the second panel slotway transverse to the second panel slotway from the second front slot side wall to the second rear slot side wall.

8. A wall panel system as claimed in claim 7 wherein:

the first tongue defined between a forwardly directed first front tongue face and a rearwardly directed first rear tongue face, in the latched condition, the first front tongue face engages the first front slot side wall and the first rear tongue face engages the first rear slot side wall to prevent movement of the first tongue forwardly and rearwardly relative to the first panel slotway, and the second tongue defined between a forwardly directed second front tongue face and a rearwardly directed second rear tongue face, in the latched condition, the second front tongue face engages the second front slot side wall and the second rear tongue face engages the second rear slot side wall to prevent movement of the second tongue forwardly and rearwardly relative to the second panel slotway.

9. A wall panel system as claimed in claim 8 wherein:

the spacing rib having a front to rear dimension greater than a front to rear spacing of the first front slot side wall and the first rear slot side wall such that the first lateral shoulder surface engages the first panel lateral end surface on each of a front side and a rear side of the vertical first entrance opening, and the spacing rib having a front to rear dimension greater than a front to rear spacing of the second front slot side wall and the second rear slot side wall such that the second lateral shoulder surface engages the second panel lateral end surface on each of a front side and a rear side of the vertical second entrance opening.

10. A wall panel system as claimed in claim 1 wherein:

in the first latched position, a downwardly directed lower surface of the first tongue engages the first slot bottom wall to prevent vertical downward movement of the first tongue relative the first wall panel, and in the second latched position, a downwardly directed lower surface of the second tongue engages the second slot bottom wall to prevent vertical downward movement of the second tongue relative the second wall panel.

11. A wall panel system as claimed in claim 1 wherein:

the first tongue has an upwardly directed first top surface, the first top surface slidably engagable with the downwardly directed first slot top wall to guide sliding of the first tongue in the first panel slotway to the first inserted unlatched position, and the second tongue has an upwardly directed second top surface, the second top surface slidably engagable with the downwardly directed second slot top wall to guide sliding of the second tongue in the second panel slotway to the second inserted unlatched position.

12. A wall panel system as claimed in claim 1 wherein:

the first panel slotway in the first panel extending from the vertical first entrance opening in the first panel lateral end surface horizontally inwardly into the first panel between the first front face and the first rear face of the first wall panel past the first transverse pin member, and the second panel slotway in the second panel extending from the vertical second entrance opening in the second panel lateral end surface horizontally inwardly into the second panel between the second front face and the second rear face of the second wall panel past the second transverse pin member.

13. A wall panel system as claimed in claim 1 wherein:

the horizontal first transverse pin member extending horizontally across the first panel slotway transverse to the first panel slotway spaced inwardly from the first panel lateral end surface, and the horizontal second transverse pin member extending horizontally across the second panel slotway transverse to the second panel slotway spaced inwardly from the second panel lateral end surface.

14. A wall panel system as claimed in claim 1 wherein:

the first wall panel is supported on a floor by a first base of the first wall panel with the first wall panel extending vertically upwardly from the first base, the second wall panel is supported on the floor by a second base of the second wall panel with the second wall panel extending vertically upwardly from the second base, the first base of the first wall panel comprises first floor engagement feet for engagement of the floor, and the second base of the second wall panel comprises second floor engagement feet for engagement of the floor.

15. A wall panel system as claimed in claim 1 wherein:

each of the first wall panel and the second wall panel comprises a space dividing wall panel, and each of the first wall panel and the second wall panel is capable of being lifted and moved manually by a user.

16. A wall panel system as claimed in claim 1 wherein:

the first wall panel comprises a first peripheral frame forming the first peripheral edges about each of the first front face and the first rear face and the first lateral end surfaces, and the second wall panel comprises a second peripheral frame forming the second peripheral edges about each of the second front face and the second rear face and the second lateral end surfaces.

17. A wall panel system comprising:

a first wall panel having a front face and a rear face and peripheral edges about each of the front face and the rear face with the peripheral edges of the front face joined to complementary peripheral edges of the rear face by first lateral end surfaces including a first panel lateral end surface disposed vertically, a first panel slotway extending vertically and longitudinally of the first panel lateral end surface between the front face and the rear face of the first wall panel inwardly into the first panel lateral end surface from a first entrance opening in the first panel lateral end surface, a first transverse pin member spanning the first panel slotway extending horizontally transverse to the first panel slotway, a second wall panel having a front face and a rear face and peripheral edges about each of the front face and the rear face with the peripheral edges of the front face joined to complementary peripheral edges of the rear face by second lateral end surfaces including a second panel lateral end surface disposed vertically, a second panel slotway extending vertically and longitudinally of the second panel lateral end surface between the front face and the rear face of the second wall panel inwardly into the second panel lateral end surface from a second entrance opening in the second panel lateral end surface, a second transverse pin member spanning the second panel slotway extending horizontally transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and the rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal end, the first tongue carrying a first hook member with an access bight open vertically downwardly, the second tongue carried on the second lateral shoulder surface extending away from the second lateral shoulder surface to a second distal end, the second tongue carrying a second hook member with an access bight open vertically downwardly, the first tongue slidable horizontally relative the first wall panel into the first panel slotway with the first distal end insertable into the first panel slotway above the first transverse pin member until, in a first inserted unlatched position, the first lateral shoulder surface engages the first panel lateral end surface about the first panel slotway limiting insertion with the access bight of the first hook member above the first transverse pin member, the second tongue slidable horizontally relative the second wall panel into the second panel slotway with the second distal end inserted into the second panel slotway above the second transverse pin member until in a second inserted unlatched position the second lateral shoulder surface engages the second panel lateral end surface about the second panel slotway limiting insertion with the access bight of the second hook member above the second transverse pin member, with the connector simultaneously in (a) the first inserted unlatched position relative the first wall panel, and (b) the second inserted unlatched position relative the second wall panel, the connector is slidable vertically downwardly to simultaneously (i) engage the first hook member about the first transverse pin member into a first latched position in which engagement between the first transverse pin member and the access bight of the first hook member prevents horizontal sliding of the connector relative to the first wall panel, and (ii) engage the second hook member about the second transverse pin member into a second latched position in which engagement between the second transverse pin member and the access bight of the second hook member prevents horizontal sliding of the connector relative to the second wall panel, with the connector simultaneously in (a) the first inserted unlatched position relative the first wall panel, and (b) the second inserted unlatched position relative the second wall panel, the spacing rib is disposed in the vertical space accessible to a user between the first panel lateral end surface and the second panel lateral end surface for engagement by the user to move the connector vertically relative the first wall panel and the second wall panel, and with the connector simultaneously in (a) the first latched position relative the first wall panel and (b) the second latched position relative the second wall panel, the spacing rib is disposed in the vertical space accessible to the user between the first panel lateral end surface and the second panel lateral end surface for engagement by the user to move the connector vertically relative the first wall panel and the second wall panel, the first panel slotway defined between a downwardly directed first slot top wall spaced upwardly from the first transverse pin member and an upwardly directed first slot bottom wall spaced downwardly from the first transverse pin member and opposed to the first slot top wall, and the second panel slotway defined between a downwardly directed second slot top wall spaced upwardly from the second transverse pin member and an upwardly directed second slot bottom wall spaced downwardly from the second transverse pin member and opposed to the second slot top wall.

18. A wall panel system, comprising:

a first wall panel having a first front face and a first rear face and first peripheral edges about each of the first front face and the first rear face with the first peripheral edges of the first front face joined to complementary first peripheral edges of the first rear face by first lateral end surfaces including a first panel lateral end surface disposed vertically, a first panel slotway in the first panel extending from a vertical first entrance opening in the first panel lateral end surface horizontally inwardly into the first panel between the first front face and the first rear face of the first wall panel, a horizontal first transverse pin member spanning the first panel slotway extending horizontally across the first panel slotway transverse to the first panel slotway, a second wall panel having a second front face and a second rear face and second peripheral edges about each of the second front face and the second rear face with the second peripheral edges of the second front face joined to complementary second peripheral edges of the second rear face by second lateral end surfaces including a second panel lateral end surface disposed vertically, a second panel slotway in the second panel extending from a vertical second entrance opening in the second panel lateral end surface horizontally inwardly into the second panel between the second front face and the second rear face of the second wall panel;

a horizontal second transverse pin member spanning the second panel slotway extending horizontally across the second panel slotway transverse to the second panel slotway, a connector removably connecting the first wall panel to the second wall panel with the first panel lateral end surface opposed to the second panel lateral end surface spaced from the second panel lateral end surface forming a vertical space between the first panel lateral end surface and the second panel lateral end surface open to both the front face and the rear face of each of the first wall panel and the second wall panel, the connector having a central vertical spacing rib, a first tongue and a second tongue, the central vertical spacing rib having a first lateral shoulder surface and a second lateral shoulder surface directed away from the first lateral shoulder surface, the first tongue carried on the first lateral shoulder surface extending away from the first lateral shoulder surface to a first distal end, the first tongue carrying a first catch arm extending in a first direction selected from downwardly and upwardly to a first distal end, the first catch arm having a first outer catch surface directed towards the first lateral shoulder surface, the second tongue carried on the second lateral shoulder surface extending away from the second lateral shoulder surface to a second distal end, the second tongue carrying a second catch arm extending in the first direction to a second distal end, the second catch arm having a second outer catch surface directed towards the second lateral shoulder surface, a second direction being opposite to the first direction, the first tongue slidable horizontally relative the first wall panel into the first panel slotway with the first distal end insertable into the first panel slotway located in the second direction relative the first transverse pin member until in a first inserted unlatched position the first lateral shoulder surface engages the first panel lateral end surface about the first panel slotway limiting insertion with the first outer catch surface of the first catch arm vertically disposed in the second direction relative the first transverse pin member, the second tongue slidable horizontally relative the second wall panel into the second panel slotway with the second distal end inserted into the second panel slotway located in the second direction relative the second transverse pin member until in a second inserted unlatched position the second lateral shoulder surface engages the second panel lateral end surface about the second panel slot way limiting insertion with the second outer catch surface of the second catch arm vertically located in the second direction relative the second transverse pin member, with the connector simultaneously in (a) the first inserted unlatched position relative the first wall panel, and (b) the second inserted unlatched position relative the second wall panel, the connector is slidable vertically in the first direction to simultaneously (i) engage the first outer catch surface of the first catch arm with the first transverse pin member and assume a first latched position in which engagement between the first transverse pin member and first outer catch surface of the first catch arm prevents horizontal sliding of the connector relative to the first wall panel in a direction that moves the first lateral shoulder surface away from first panel lateral end surface, and (ii) engage second outer catch surface of the second catch arm with the second transverse pin member and assume a second latched position in which engagement between the second transverse pin member and the second outer catch surface of the second catch arm prevents horizontal sliding of the connector relative to the second wall panel in a direction that moves the second lateral shoulder surface away from second panel lateral end surface, with the connector simultaneously in (a) the first inserted unlatched position relative the first wall panel, and (b) the second inserted unlatched position relative the second wall panel, the spacing rib is disposed in the vertical space accessible to a user between the first panel lateral end surface and the second panel lateral end surface for engagement by the user to move the connector vertically relative the first wall panel and the second wall panel, and with the connector simultaneously in (a) the first latched position relative the first wall panel, and (b) the second latched position relative the second wall panel, the spacing rib is disposed in the vertical space accessible to the user between the first panel lateral end surface and the second panel lateral end surface for engagement by the user to move the connector vertically relative the first wall panel and the second wall panel, the first panel slotway defined between a downwardly directed first slot top wall spaced upwardly from the first transverse pin member and an upwardly directed first slot bottom wall spaced downwardly from the first transverse pin member and opposed to the first slot top wall, and the second panel slotway defined between a downwardly directed second slot top wall spaced upwardly from the second transverse pin member and an upwardly directed second slot bottom wall spaced downwardly from the second transverse pin member and opposed to the second slot top wall.

* * * * *